US010297107B2

(12) United States Patent
Bjornebark et al.

(10) Patent No.: US 10,297,107 B2
(45) Date of Patent: May 21, 2019

(54) RESERVE-FUNDED WAGERING GAME SYSTEM

(71) Applicant: Bally Gaming, Inc., Las Vegas, NV (US)

(72) Inventors: Tom J C Bjornebark, Avesta (SE); Linus Dalin, Stockholm (SE); Damon E. Gura, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 378 days.

(21) Appl. No.: 14/534,048

(22) Filed: Nov. 5, 2014

(65) Prior Publication Data

US 2015/0126273 A1 May 7, 2015

Related U.S. Application Data

(60) Provisional application No. 61/900,096, filed on Nov. 5, 2013.

(51) Int. Cl.
*G07F 17/32* (2006.01)

(52) U.S. Cl.
CPC ..... *G07F 17/3255* (2013.01)

(58) Field of Classification Search
None
See application file for complete search history.

(56) References Cited

U.S. PATENT DOCUMENTS

| | | | | |
|---|---|---|---|---|
| 7,896,735 | B2 | 3/2011 | Kelly et al. | |
| 8,753,194 | B2 | 6/2014 | Schneider et al. | |
| 8,764,566 | B2 | 7/2014 | Miltenberger et al. | |
| 2003/0064805 | A1 | 4/2003 | Wells | |
| 2004/0242322 | A1 | 12/2004 | Montagna et al. | |
| 2005/0192086 | A1 | 9/2005 | Walker et al. | |
| 2005/0272492 | A1 | 12/2005 | Stelly | |
| 2007/0202941 | A1 * | 8/2007 | Miltenberger | G07F 17/32 463/25 |
| 2009/0069087 | A1 | 3/2009 | Kelly et al. | |
| 2009/0319368 | A1 * | 12/2009 | Reardon | G06Q 20/10 705/14.51 |
| 2011/0118004 | A1 | 5/2011 | Kelly et al. | |
| 2012/0122555 | A1 | 5/2012 | Schneider et al. | |
| 2012/0190433 | A1 | 7/2012 | Rowe | |
| 2013/0079115 | A1 | 3/2013 | Nelson et al. | |
| 2013/0079116 | A1 | 3/2013 | Nelson et al. | |
| 2013/0225270 | A1 | 8/2013 | Kelly et al. | |

FOREIGN PATENT DOCUMENTS

| | | |
|---|---|---|
| WO | 2007100744 | 9/2007 |
| WO | 2013048684 | 4/2013 |

* cited by examiner

*Primary Examiner* — James S. McClellan
*Assistant Examiner* — Peter J Iannuzzi
(74) *Attorney, Agent, or Firm* — Michael Blankstein; Philip J. Anderson

(57) ABSTRACT

A wagering game system and its operations are described herein. The operations can include accessing a player account and reserving a portion of funds from the player account in a reserve account, such as an escrow account and/or a credit account. The operations can further include permitting play of a wagering game after the reserving the portion of the funds from the player account in the reserve account. The operations can further include, in response to a wager drawn from the portion of the funds in the reserve account, initiating a round of play of the wagering game.

21 Claims, 14 Drawing Sheets

RESERVE-FUNDED WAGERING GAME SYSTEM

RELATED APPLICATIONS

This application claims the priority benefit of U.S. Provisional Application Ser. No. 61/900,096 filed Nov. 5, 2013. The 61/900,096 Application is incorporated herein by reference in its entirety.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2014, WMS Gaming, Inc.

TECHNICAL FIELD

Embodiments of the inventive subject matter relate generally to wagering game systems and networks that, more particularly, financial transactions for wagering game play.

BACKGROUND

Wagering game machines, such as slot machines, video poker machines and the like, have been a cornerstone of the gaming industry for several years. Traditionally, wagering game machines have been confined to physical buildings, like casinos (e.g., resort casinos, road-side casinos, etc.). The casinos are located in specific geographic locations that are authorized to present wagering games to casino patrons. However, with the proliferation of interest and use of the Internet, shrewd wagering game manufacturers have recognized that a global public network, such as the Internet, can reach to various locations of the world that have been authorized to present wagering games. Any individual with a personal computing device (e.g., a personal computer, a laptop, a personal digital assistant, a cell phone, etc.) can connect to the Internet and play wagering games. Consequently, some wagering game manufacturers have created wagering games that can be processed by personal computing devices and offered via online casino websites ("online casinos"). However, online casinos face challenges and struggles. For instance, communication between various devices spread across a global network, such as the Internet, may include delays to the online wagering game process. Delays to the online wagering game process can negatively affect a wagering game player's satisfaction with the gaming process, which in turn can negatively affect the online wagering game business. As a result, wagering game manufacturers, casino operators, and online game providers are constantly in need of innovative concepts that can make the online gaming industry appealing and profitable.

BRIEF DESCRIPTION OF THE DRAWING(S)

Embodiments are illustrated in the Figures of the accompanying drawings in which.

Figure 4:
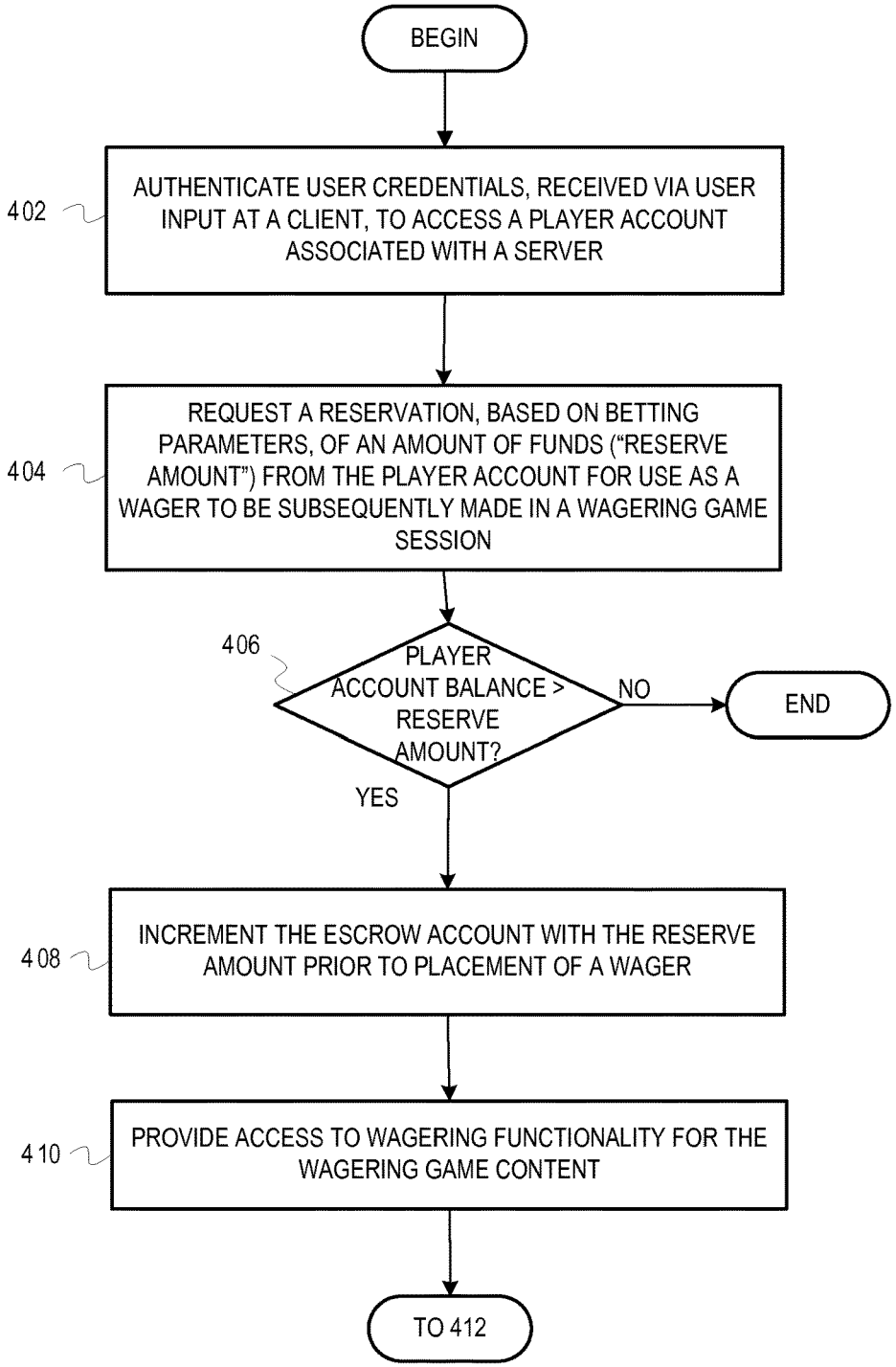
Figure 5:
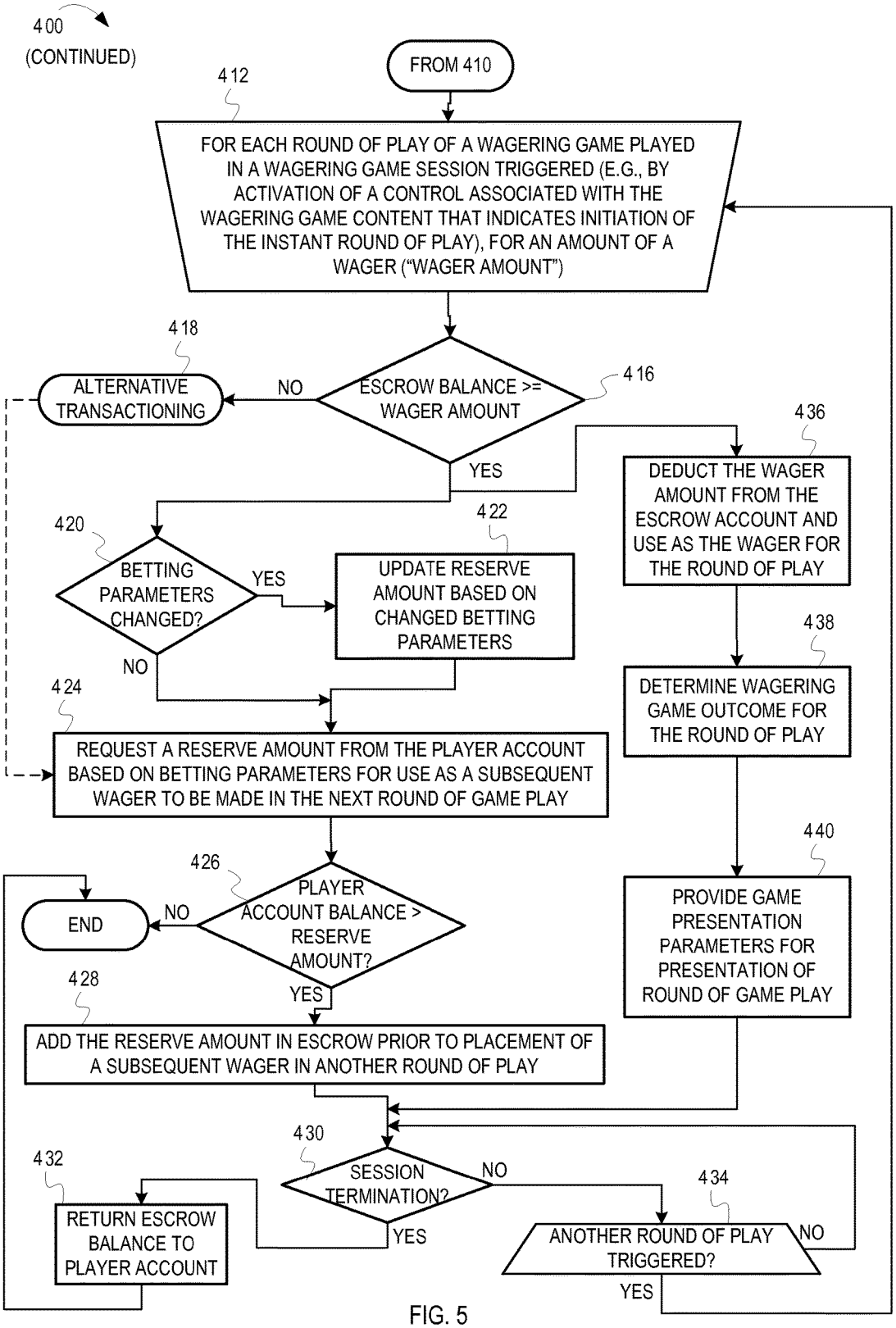
Figure 6:
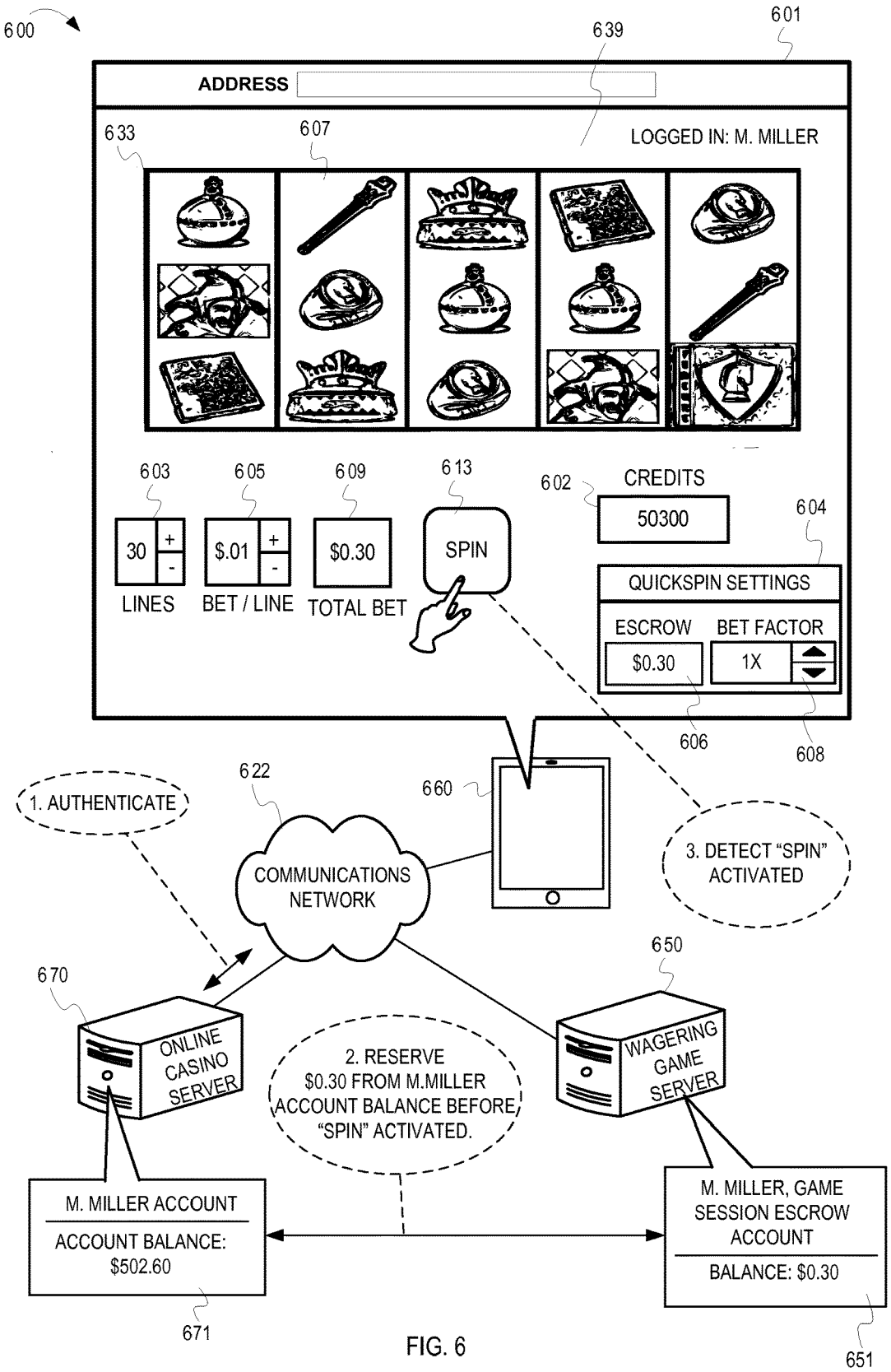
Figure 7:
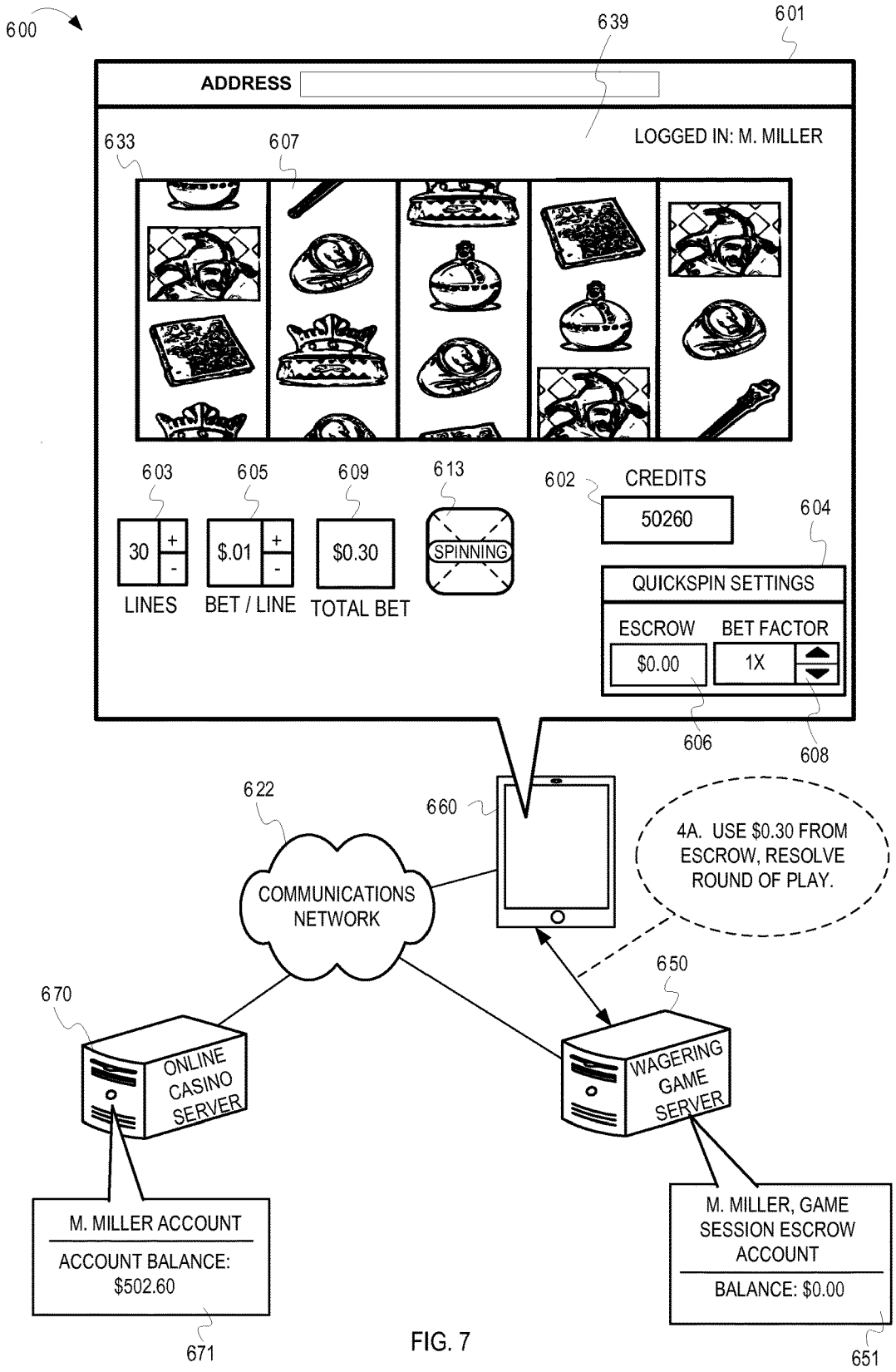
Figure 8:
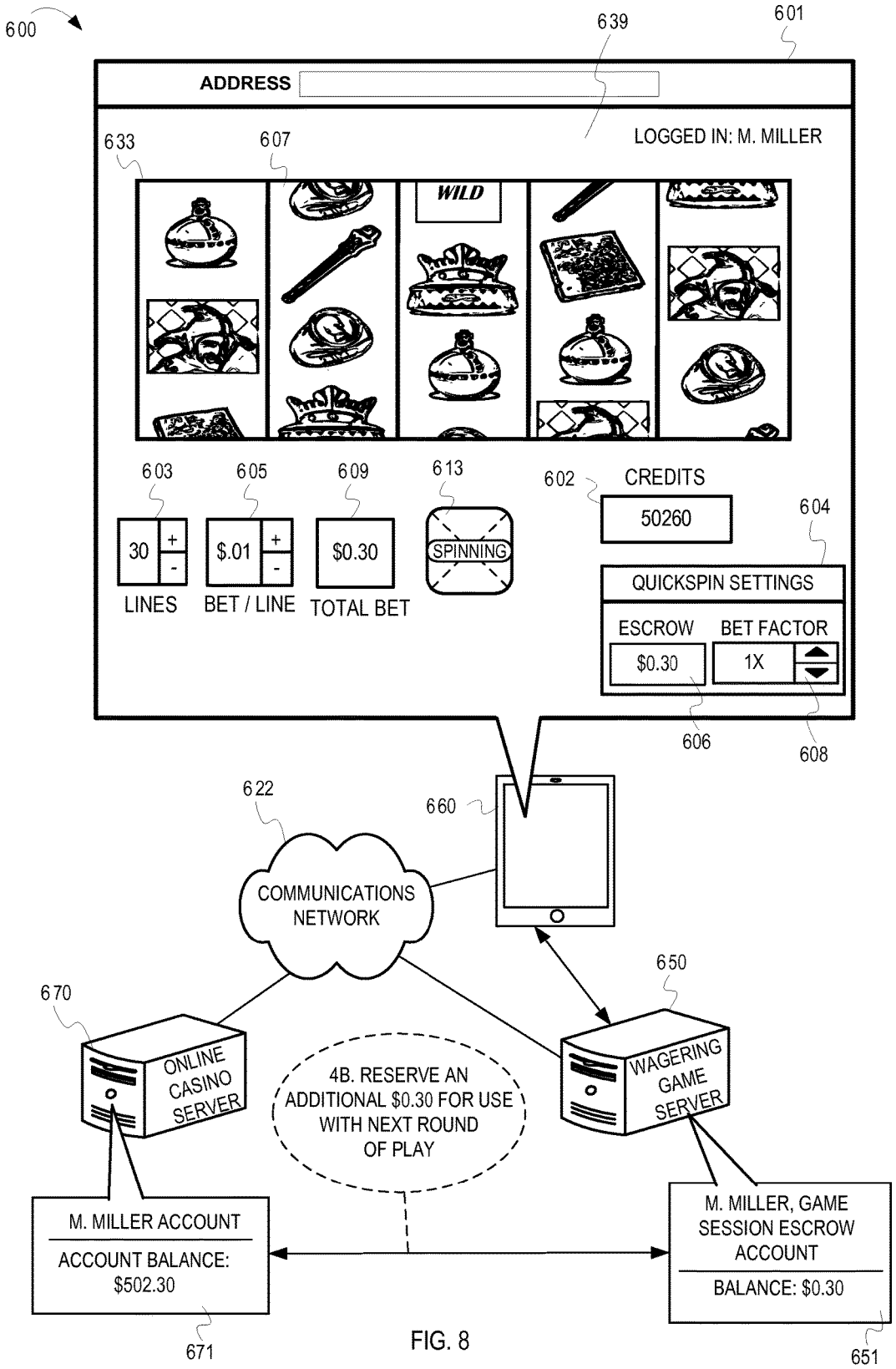
Figure 9:
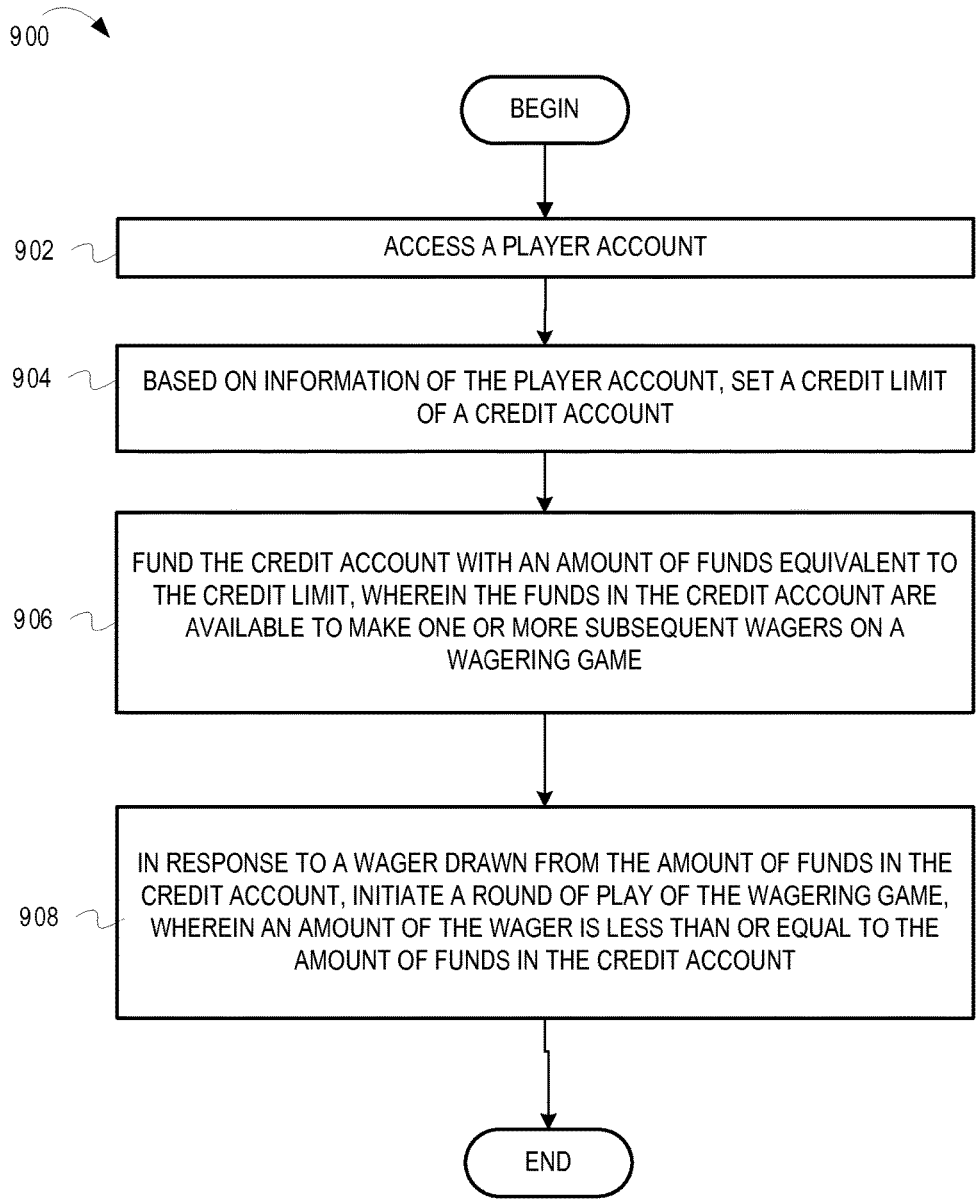
Figure 10:
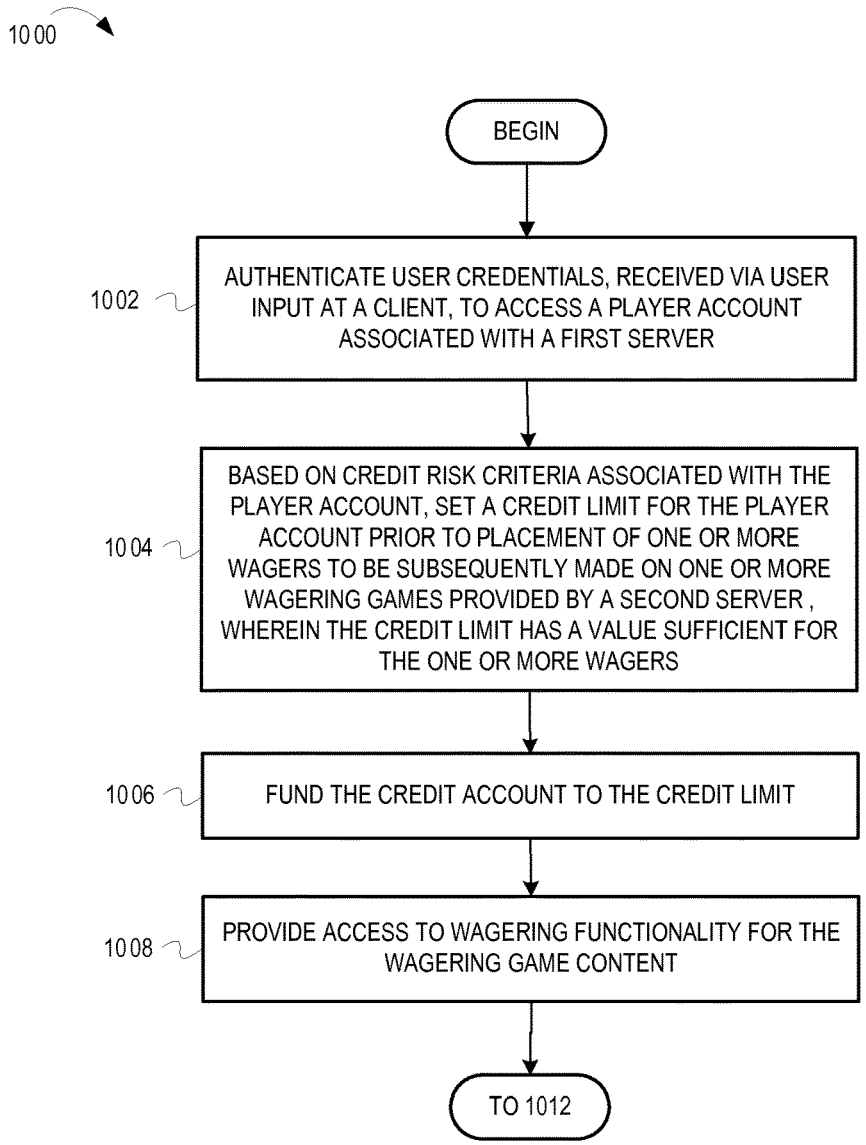
Figure 11:
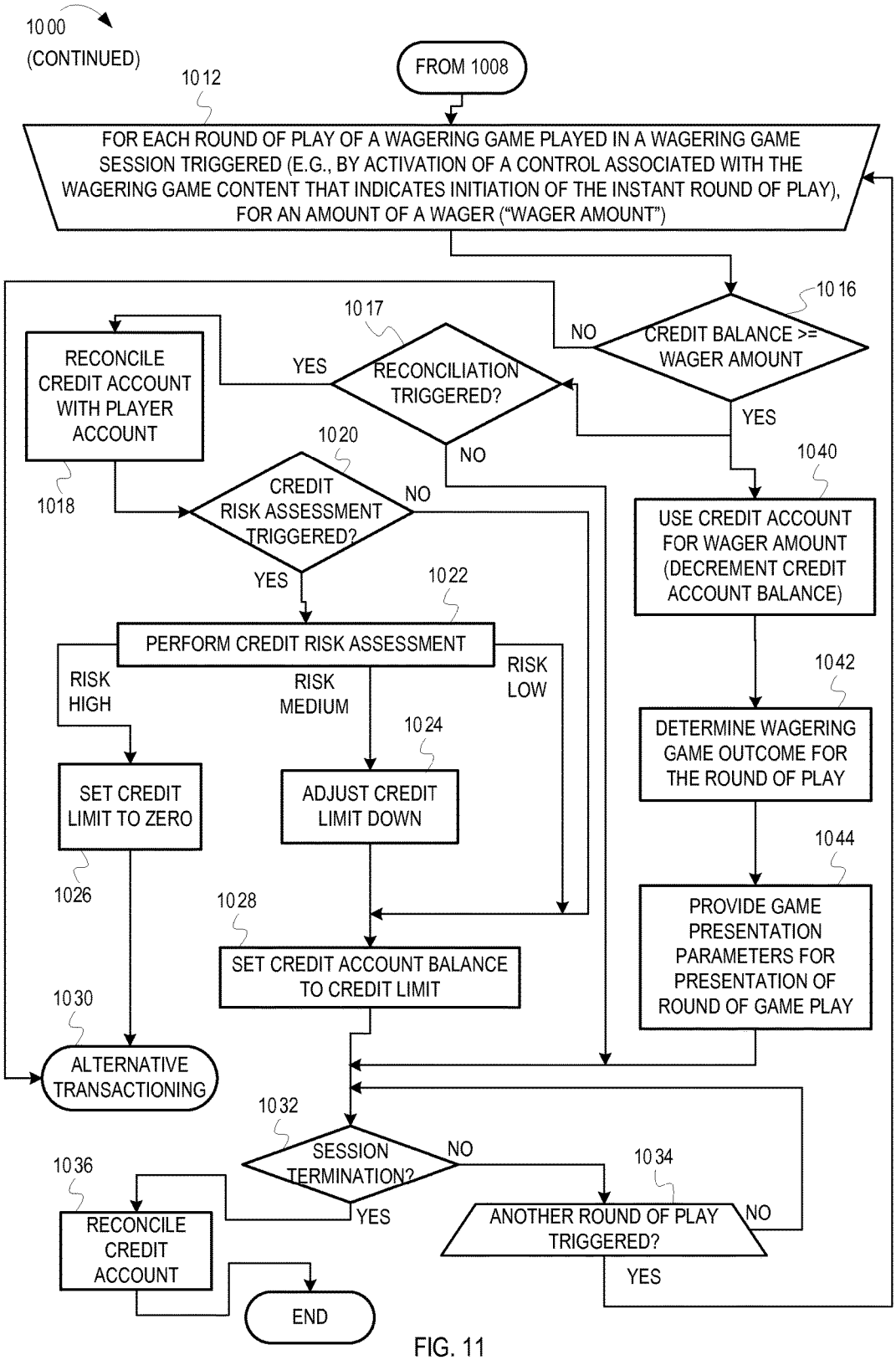
Figure 12:
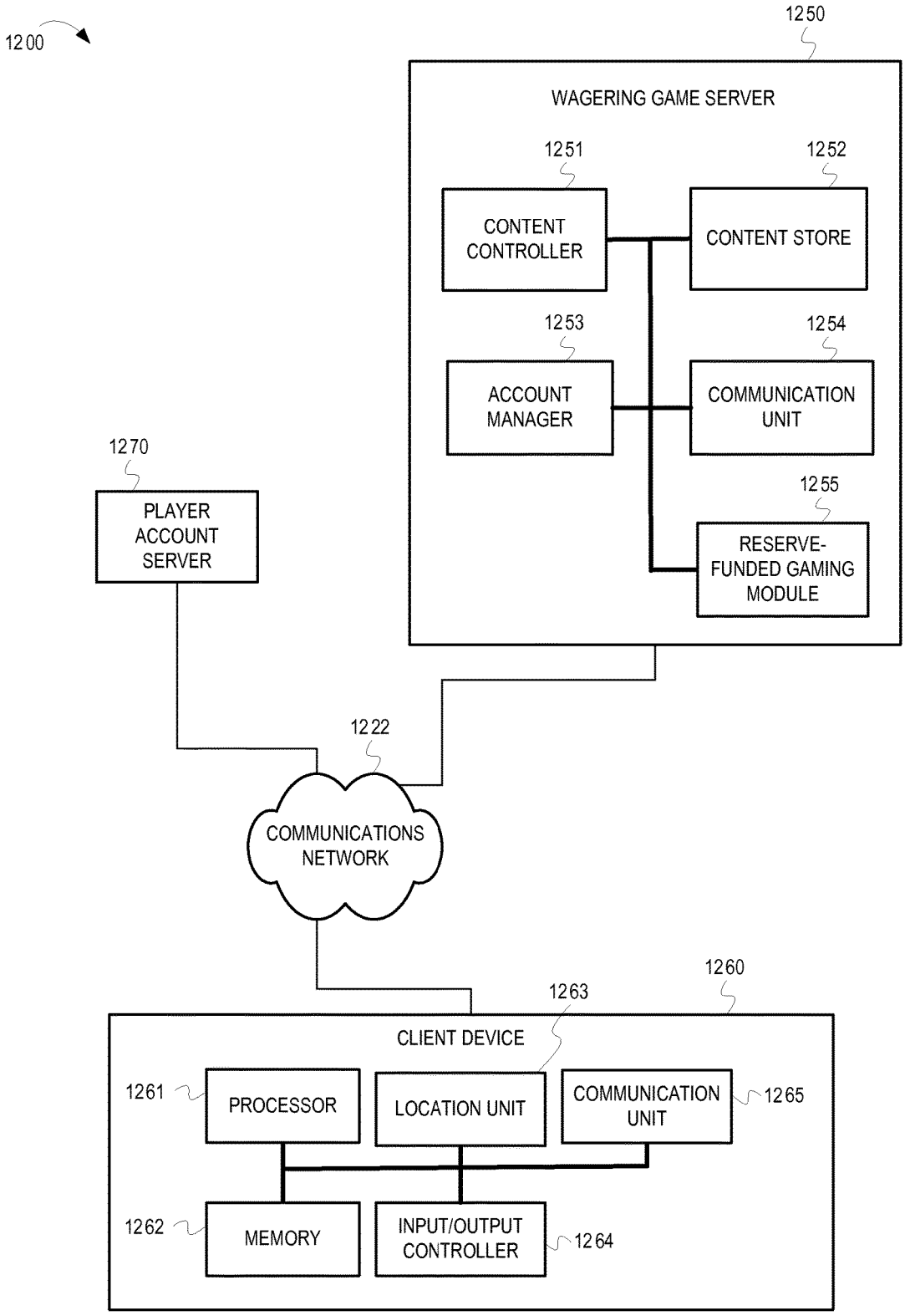
Figure 13:
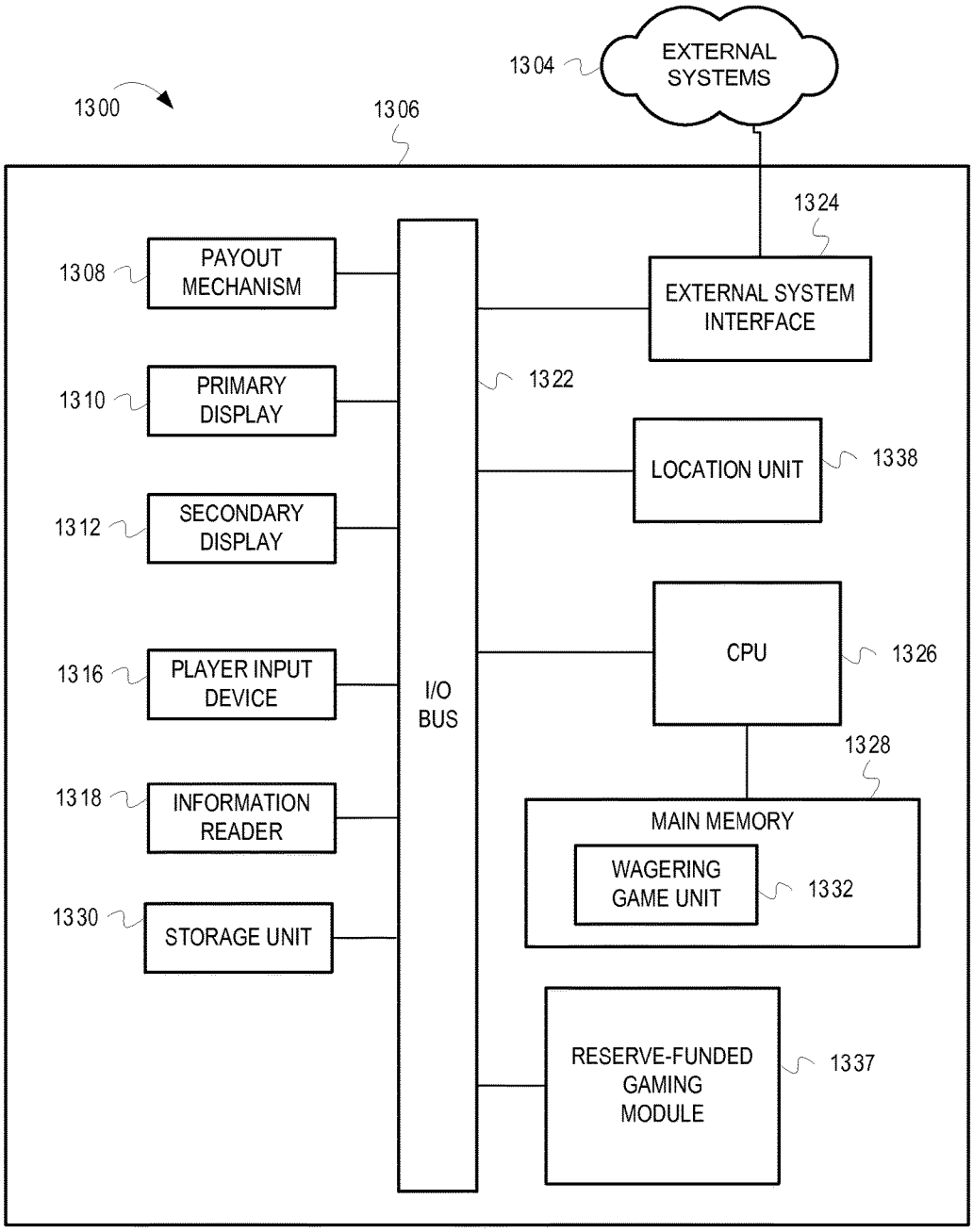
Figure 14:
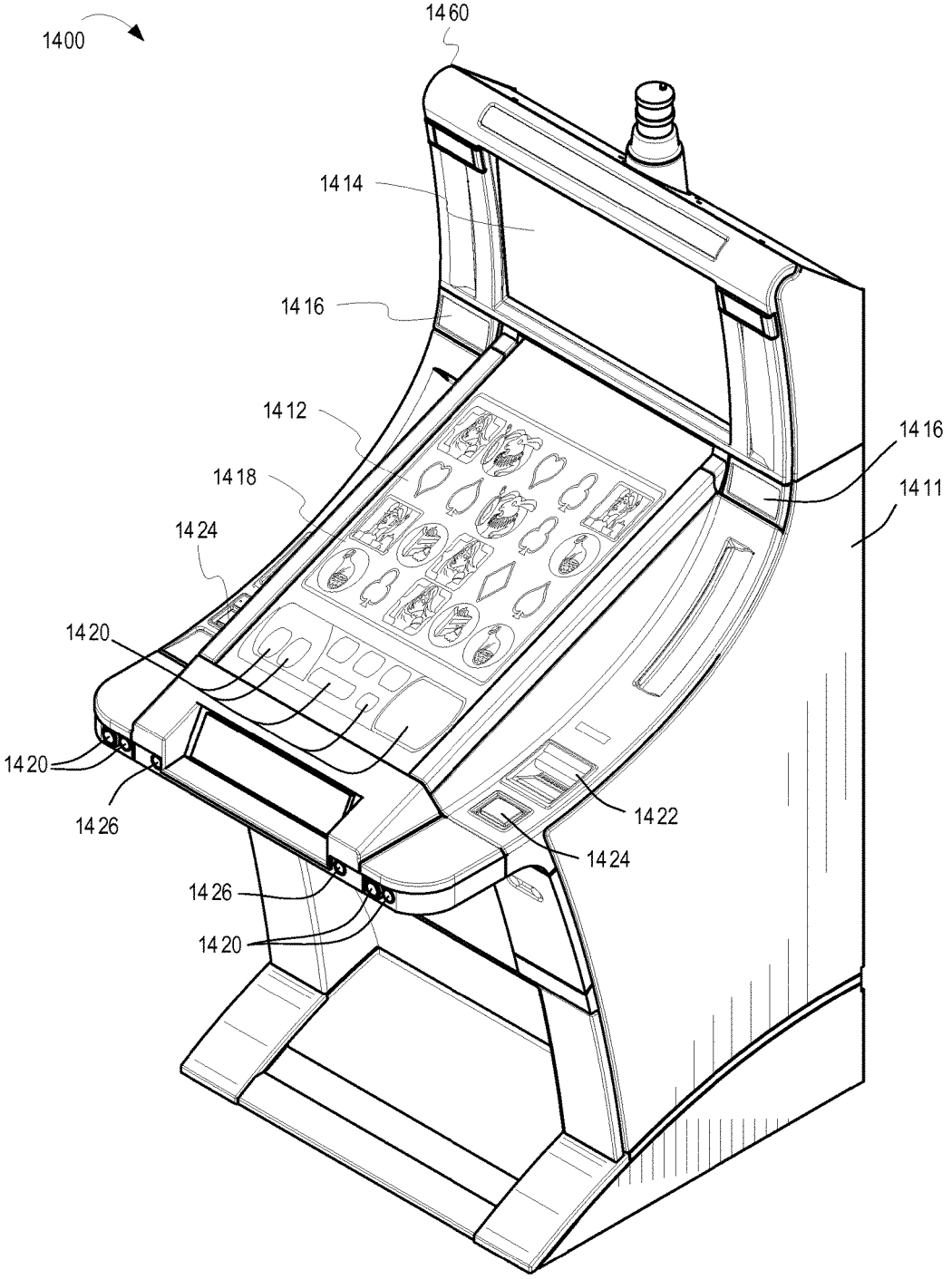

FIGS. 4 and 5 include a flow diagram ("flow 400") illustrating reserving and using funds in an escrow account, according to some embodiments;

FIGS. 6, 7 and 8 are illustrations of reserving and using funds in escrow for an online wagering game, according to some embodiments;

FIG. 9 is a flow diagram 900 illustrating establishing and using credit for wagering game play, according to some embodiments;

FIGS. 10 and 11 include a flow diagram ("flow 1000") illustrating establishing and using credit for wagering game play, according to some embodiments;

FIG. 12 is an illustration of a wagering game system architecture 1200, according to some embodiments;

FIG. 13 is an illustration of a wagering game machine architecture 1300, according to some embodiments; and FIG. 14 is an illustration of a wagering game system 1400, according to some embodiments.

DESCRIPTION OF ILLUSTRATIVE EMBODIMENTS

This description of the embodiments is divided into five sections. The first section provides an introduction to embodiments. The second section describes example operations performed by some embodiments while the third section describes additional example embodiments. The fourth section describes example operating environments while the fifth section presents some general comments.

For purposes of the present detailed description, a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Furthermore, for purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or online casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Further, some embodiments of the inventive subject matter describe examples of reserve-funded gaming in a network wagering venue (e.g., an online casino, a wagering game website, a wagering network, etc.) using a communication network. Embodiments can be presented over any type of communications network that provides access to wagering games, such as a public network (e.g., a public wide-area-network, such as the Internet), a private network (e.g., a private local-area-network gaming network), a peer-to-peer network, a social network, etc., or any combination of networks. Multiple users can be connected to the networks via computing devices. The multiple users can have accounts that utilize specific services, such as account-based wagering services (e.g., account-based wagering game websites, account-based casino networks, etc.).

Introduction

This section provides an introduction to some embodiments.

In a physical casino, a wagering game player ("player") can play a wagering game machine (also known as an electronic gaming machine, or EGM). The EGM can, for example, present a slot-type wagering game, which may include some form of reels (e.g., mechanical reels, virtual reels presented on a display, etc.). The reels can include an array of symbols. The player can place a wager on what a potential outcome for the reels will reveal. After indicating an amount for the wager, the player activates the spin, typically, by pressing a "spin" button or pulling a lever. The reels can appear to spin for some period of time and then stop to reveal a random wagering game outcome (e.g., a specific reel-stop configuration of the reel symbols selected based on a random number). The placement of the wager (e.g., in response to the user input to initiate the play of the game using the wager amount), the presentation of the game play (e.g., the spinning of the reels), and the reveal of the outcome may be referred to as a round of play, or a wagering cycle, for the wagering game. The EGM can transact the round of play without significant delays, because, for example, the wagering game content and/or wagering funds are either stored on the wagering game machine or are accessible via a fast private network. Session balances can be stored on a memory storage device of the EGM (e.g., on local memory) for rapid accounting. In some instances, an EGM may communicate with a server in the physical casino network to transact wagers during a wagering game session and/or to access wagering game content.

Some jurisdictions may set a minimum time period between when a player can activate, or request initiation of, successive rounds of play. EGMs in those jurisdictions may be programmed to cause a delay to the play of the game based on those jurisdictional restrictions. However, physical casino venues (including the EGMs, host servers, and/or network devices) are designed and dedicated to make very fast wagering transactions. Therefore, wagering transactions conducted via an EGM introduce little to no delays between successive rounds of play on the EGM. Thus, in a physical casino, a player can initiate activation of rounds of play in rapid succession, essentially as fast as jurisdictional restrictions will allow.

However, in an online environment, there are various factors that can introduce unintended, or undesired, delays into the wagering game process beyond any intentional jurisdictional delays. For example, the distance between physical devices (e.g., between servers) can introduce network communication latencies. For example, communications between game providers and third-party host servers and/or player account servers can introduce accounting transaction delays. These delays can slow down a player's online playing experience, which can negatively affect a player's enjoyment of online wagering game play. For example, FIG. 1 shows an example of a type of delay that can occur to online gaming when a wagering game server communicates with a third-party server.

Figure 1:
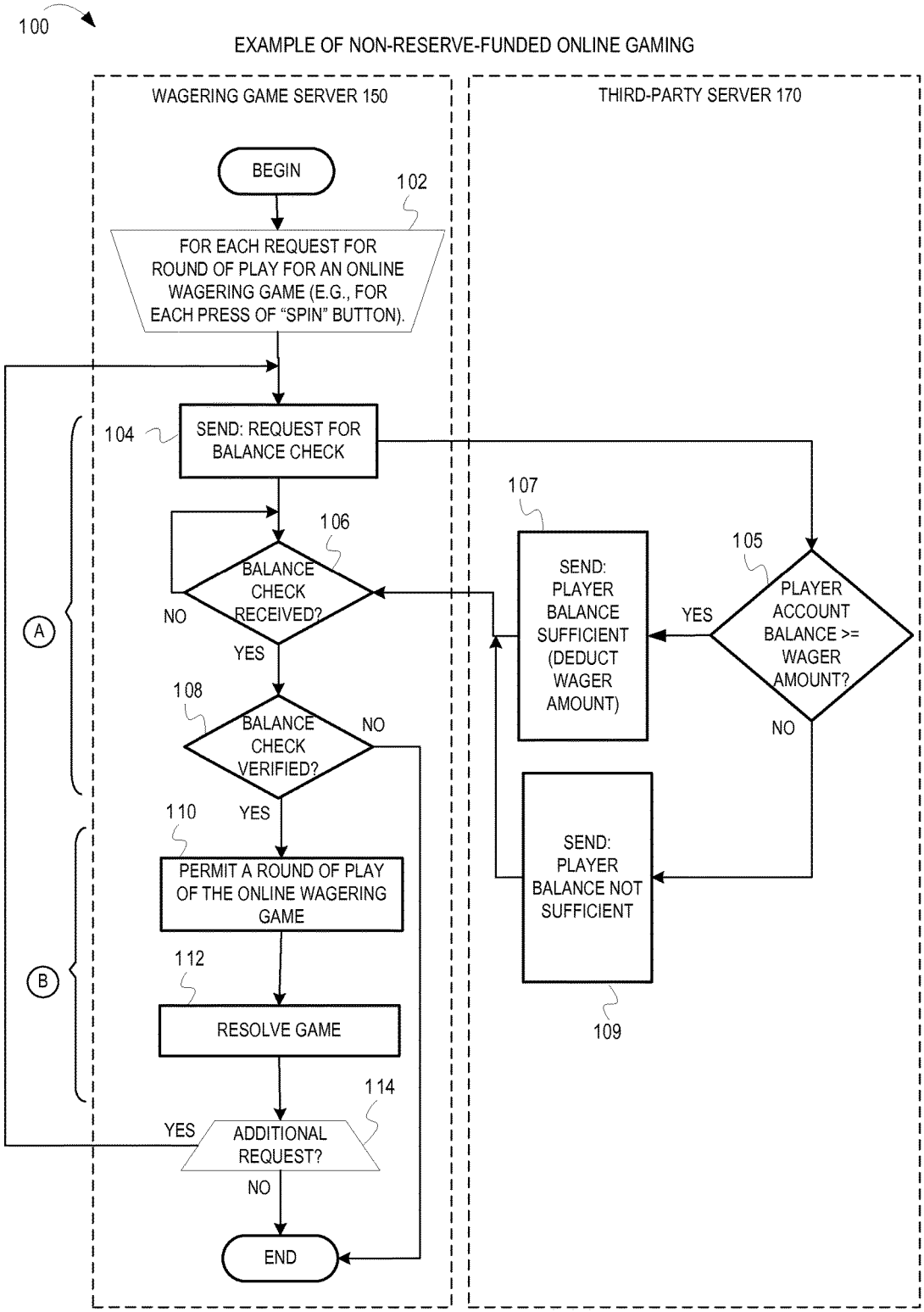
FIG. 1 is a flow diagram 100 illustrating managing an online wagering game without using a reserve account.

FIG. 1 is a flow diagram 100 illustrating managing an online wagering game without using a reserve account. In other words, the example of FIG. 1 illustrates a procedure that draws funds directly from a player account balance without using a local, intermediary account in which a reserve amount of funds are stored for quick access during a wagering game. In FIG. 1, a wagering game server 150 communicates with a third-party server 170 (e.g., across a communications network, such as the Internet). The wagering game server 150 hosts wagering game content, such as a slot game that can be presented on a website associated with third-party server 170. The third party server 170 hosts a player account, which includes monetary funds that can be used for wagering. The wagering game server 150 and the third-party server 170 may be associated with different entities, and therefore may be on separate private networks, which both have access to the Internet. Communications between the wagering game server 150 and the third-party server 170 may be conducted across the Internet via secured communications. Transactions that occur via the communications require passing of data across the Internet, which takes time and can result in some delays depending on the state of the separate devices, the state of the separate private networks, the state of communication devices on the Internet, etc.

In the flow 100 of FIG. 1, the wagering game server 150 detects, at processing block 102, that a client (associated with a wagering game player) requests initiation of a round of play. The client may indicate a wager amount for the round of play.

After the wagering game server 150 detects the request to initiate the round of play, stage "A" begins (Stage A), during which the wagering game server 150 and the third-party server 170 must communicate regarding the wager amount. For instance, at processing block 104, the wagering game server 150 requests a balance check, in the amount of the wager, from the third-party server 150. The balance check is to determine whether the player account has sufficient funds to cover the wager made in the wagering game.

At processing block 106, the wagering game server 150 waits for the response from the third-party server 170 regarding the balance check. In some instances, the period for response can take significant amounts of time (e.g., a varied number of seconds based on network conditions) during which time the player must wait before wagering game play can continue. Meanwhile, the third-party server 170 receives the balance check request. At processing block 105, the third-party server 170 determines whether the player account balance is greater than or equal to the wager amount. If the player account balance is greater than or equal to the wager amount, the third-party server 170, at processing block 107, communicates back to the wagering game server 150 that the player account balance was sufficient to cover the bet. The third-party server also deducts the wager amount from the player account. If the player account balance was not sufficient, then, at processing block 109, the third-party server 170 communicates back to the wagering game server 150 that the balance was not sufficient.

After receiving a response from the server, the wagering game server 150, at processing block 108, determines whether the response verified that the player was sufficient or not sufficient to cover the amount of the wager. If, at processing block 108, the wagering game server 150 determines that the player account has insufficient funds to cover the wager, the wagering game server 150 does not permit performance of the round of play, and the flow 100 ends. If, however, at processing block 108, the wagering game server 150 determines that the player account balance is sufficient to cover the wager, the wagering game server 150, at processing block 110, permits the client to present (or continue to present) the round of play for the online wagering game. For example, the wagering game server 150 may send a message to a client to cause reels to begin spinning on a display. In another example, at processing block 104, the wagering game server 150 may have already communicated to the client to begin spinning the reels. The reels would then spin through the duration of Stage A. In such an example, if the balance check was verified (i.e., the third-party server 170 indicated that the player account had sufficient funds to cover the wager amount), then the reels would continue spinning and/or a credit meter may be reduced to indicate that the wager was covered. If, however the third-party server 170 had indicated insufficient funds in the player account, the wagering game server 150 could indicate to the client to stop spinning the reels, specify that the player account cannot cover the wager, and terminate game play until the player account balance has been augmented.

Stage "B" (Stage B) commences when the wagering game server 150 has permitted the round of play of the wagering game to begin (or continue). At processing block 110, the wagering game server 150 resolves the round of play for the online wagering game. For example, the wagering game server 150 may determine a wagering game outcome, indicate to the client a symbol array to present based on the wagering game outcome, provide any additional data based on the wagering game outcome (e.g., data related to a congratulatory message, data related to an updated player account, data related to presentation of paylines, data related to bonus rounds, data related to credit meter augmentation, etc.), or perform any other step to complete the round of play.

After Stage B, the wagering game server 150 then detects whether an additional request is made for another round of play for the wagering game, at which time one or more of the processing blocks of the flow 100 repeat. In this example, Stage A must occur before Stage B to verify whether the player account has sufficient funds to cover a wager amount. Thus, the time period for Stage A is added to the time period of Stage B resulting in a combined period of time. In some examples, communications between the wagering game server 150 and the third-party server 170 may take longer than others based on network conditions associated with the wagering game server 150, the third-party server 170, or any other intervening communication devices involved with online communications.

However, some embodiments of the inventive subject matter involve pre-funding a reserve account (e.g., as described in FIG. 2) with funds from which wagers can be immediately drawn during a round of play of an online wagering game instead of having to access the player account for the funds during the round of play (e.g., as described in FIG. 1). The reserve account can be pre-funded, based on funds from a player account hosted by a third-party server, prior to a request by the player for initiation of the round of play for the online wagering game, for example, when the player accesses or logs in to a wagering game website. Funds from the reserve account are drawn to make a wager for the round of play. In some embodiments, during the round of play (from which the wager is transacted using the reserve account), the reserve account is replenished via the funds from the player account for a subsequent round of play that has yet to be initiated (e.g., replenished funds are available for use in a subsequent round of play of the online wagering game that the player may initiate after the current round of play). Thus, is some embodiments, such as the example illustrated in FIG. 2, the online wagering game, or more specifically, a computer system that manages the online wagering game, pre-authorizes funds and stores the funds in a location that the server can quickly and easily access prior to initiating a round of play, without the delay that would occur if the system had to access funds from the player account on the third-party server across the Internet. Thus, in some embodiments, the system can provide quick successive play of an online wagering game. The example of FIG. 2 will now be described in detail.

Figure 2:
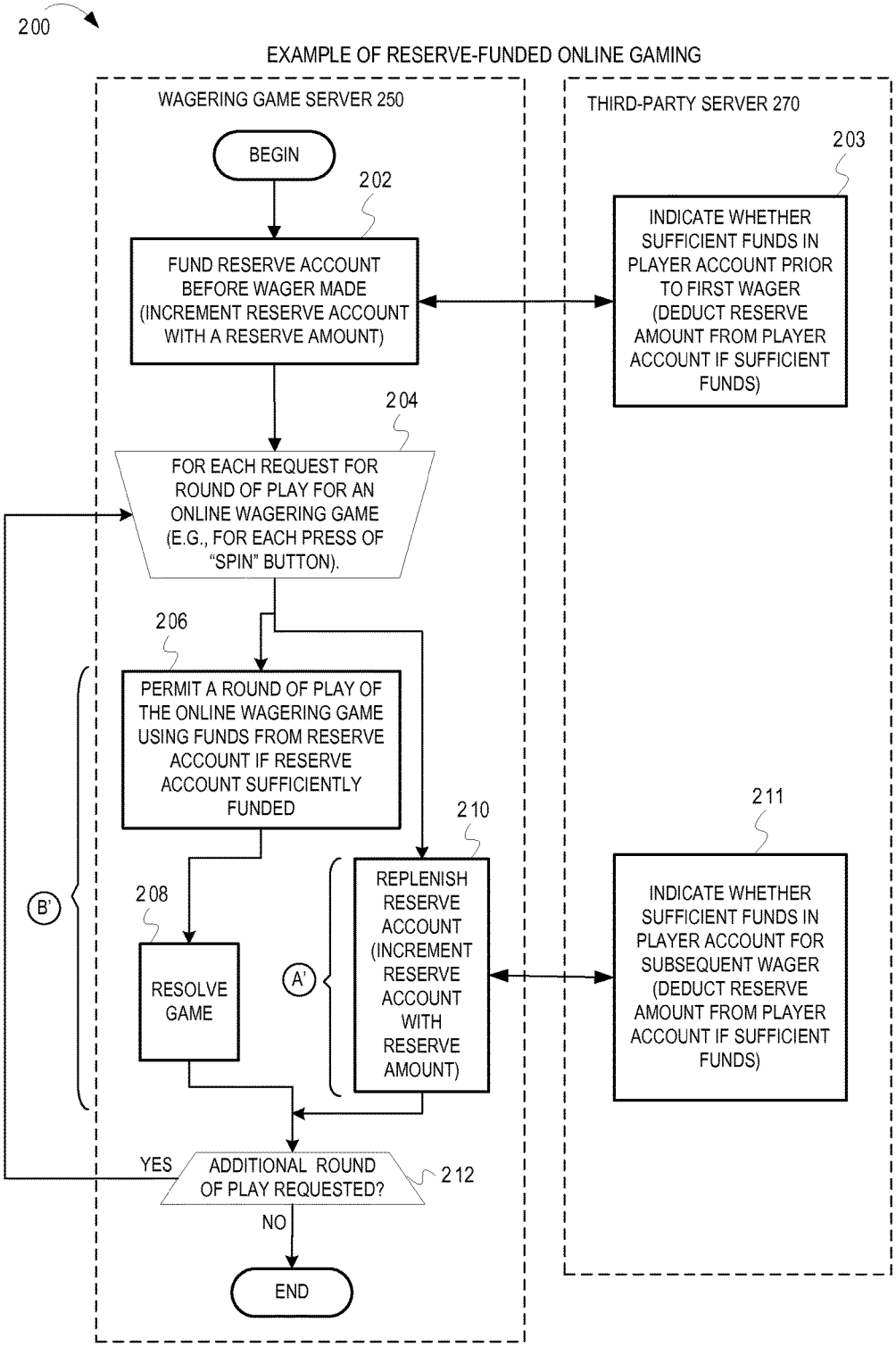
FIG. 2 is a flow diagram 200 illustrating managing an online wagering game using a reserve account, according to some embodiments.

FIG. 2 is a flow diagram 200 illustrating managing an online wagering game using a reserve account, according to some embodiments. In FIG. 2, the flow 200 begins, at processing block 202, with a wagering game server 250 funding a reserve account (e.g., an escrow account or a credit account) before a wager is made. For example, the wagering game server 250 communicates with a third-party server 270 to determine whether a player account can cover a default wager amount (e.g., a maximum bet amount for the wagering game) to initiate a round of play for an online wagering game. The wagering game server 250 can fund the reserve account using a similar method as that described in Stage A of FIG. 1. For example, the wagering game server 250 can send a request to the third-party server 270 for a balance check for a default amount (e.g., for a maximum possible bet value of a wagering game). If, at processing block 203, the third-party server 270 indicates that a balance of the player account is sufficient for the default amount, then the wagering game server 250 stores in the reserve account an amount equivalent to the default amount.

At processing block 204, the wagering game server 250 detects a request by the client to initiate a round of play for the wagering game. For example, the client receives user input that indicates a request to initiate the round of play (e.g., the user presses a "spin" activation control for a slot wagering game).

After processing block 204, the flow 200 splits into parallel processes, where stage "A'" (Stage A') and stage "B'" (Stage B') occur concurrently. At processing block 206, the wagering game server 250 permits the round of play using funds from the reserve account. The funds for the reserve account may be stored in, for example, an escrow account, a credit account, or some other type of account that stores at least a portion of funds that belong to, or are associated with, the player account, and which are readily accessible to, the wagering game server 250. Therefore, after the client detects a request to initiate the round of game play, the wagering game server 250 does not need to communicate across the Internet with the third-party server 270 to verify a player account balance. Thus, the use of the reserve account at processing block 206 reduces, or eliminates the possibility of potential delays that would occur if instead the wagering game server 250 had to communicate, during the round of play, across the Internet and/or perform a transaction, during the round of play, that required a response from the third-party server 270. Instead, the wagering game server 250 simply uses the funds from the reserve account, which are stored locally on the wagering game server 250, and/or are stored on a device accessible to the wagering game server 250, such as a device connected to the wagering game server 250 or accessible through a local area network to which the wagering game server 250 is connected. The flow 200 continues, at processing block 208, where the wagering game server 250 resolves the round of play for the online wagering game (e.g., as similarly described for stage B of FIG. 1 at processing block 110).

Concurrently, for stage A' the wagering game server 250, at processing block 210, replenishes the reserve account 210, such as by communicating with the third-party server 270 whether the player account, on the third-party server 270, has sufficient funds to cover any additional wagers that may be made for future additional rounds of game play that have not yet been initiated (e.g., for an additional round of play that may be requested at processing block 212). For example, the wagering game server 250 can send a request to the third-party server 270 for a balance check for an amount ("reserve amount") equivalent to the wager that was just made. In other examples, the wagering game server 250 can send a request to the third-party server 270 for a balance check for the default amount that was requested prior to play of the wagering game (e.g., for the maximum possible bet value of the wagering game). At processing block 211, if the third-party server 270 indicates that the balance of the player account is sufficient for the reserve amount (i.e., is greater than or equal to the reserve amount), then the wagering game server 250 increments the reserve account with the reserve amount. The third-party server 270, at processing block 211, further subtracts the reserve amount from the player account.

Because the time periods for Stage A' and Stage B' overlap either entirely, or at least to some degree (as opposed to FIG. 1 where Stage A and Stage B did not overlap), then delays are reduced or eliminated. Furthermore, a player can more rapidly play successive rounds of wagering games because funds for wager amounts are pre-reserved and readily accessible without having to reconcile a player account stored on a remote third-party server after a round of play has been initiated.

Although FIG. 2 describes some embodiments, the following sections describe many other features and embodiments.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
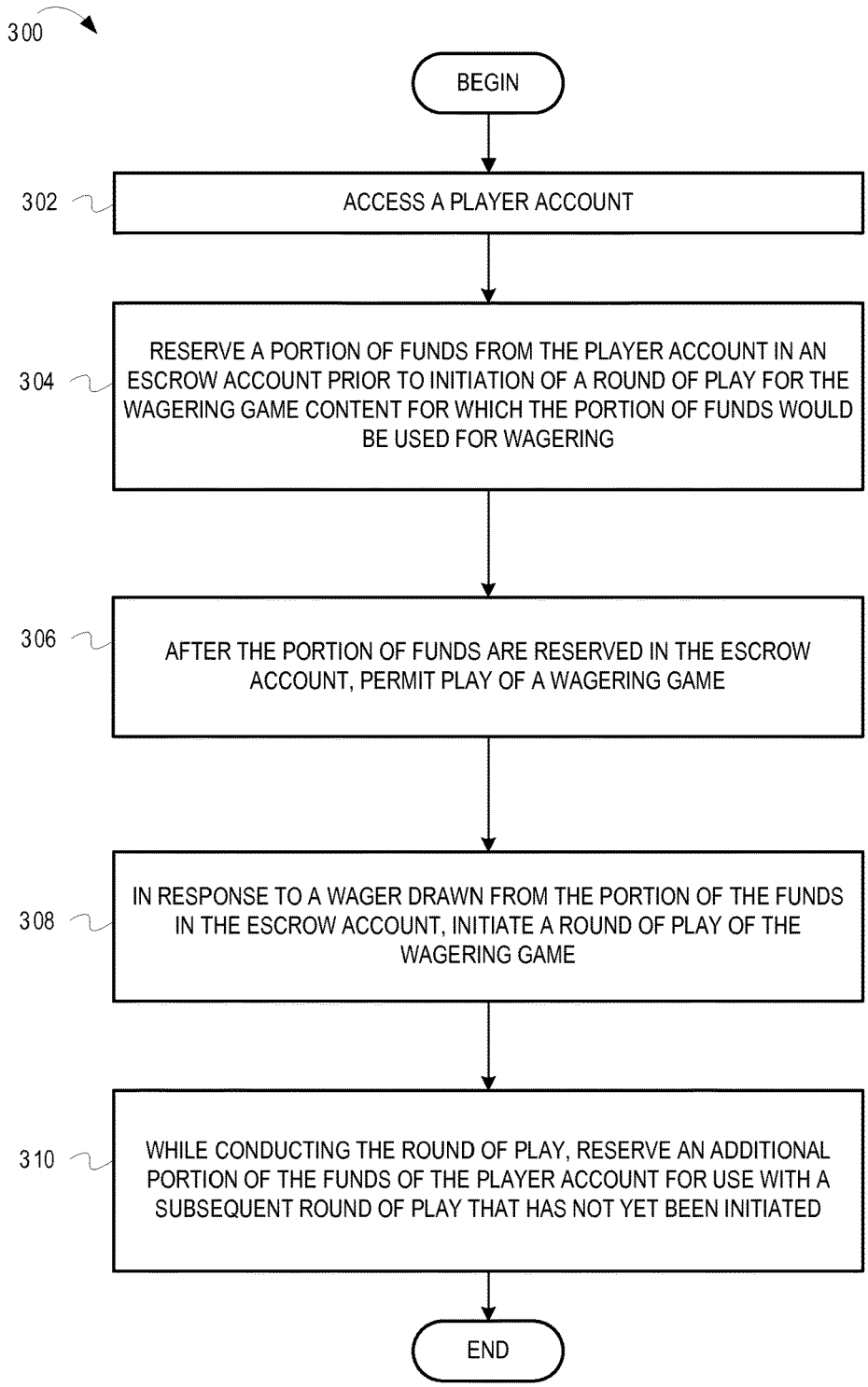
FIG. 3 is a flow diagram 300 illustrating reserving funds in escrow for a wagering game, according to some embodiments.

FIG. 3 is a flow diagram 300 illustrating reserving funds in escrow for a wagering game, according to some embodiments. In FIG. 3, the flow 300 begins at processing block 302, where a wagering game system ("system") accesses a player account. For example, the system may include a wagering game server (e.g., wagering game server 250 illustrated in FIG. 2), configured to connect to a wagering game player account hosted by a third-party server (e.g., third-party server 270). The third-party server can be associated with a first entity that provides access to a wagering game website, such as an online casino. The first entity is separate from a second entity (e.g., a wagering game provider) associated with the wagering game server. Users can access the online casino via a website on the Internet. The website can indicate branding for the online casino. In some embodiments, a user can log on to the online casino using credentials for the player account. The third-party server may subscribe to a service provided by the wagering game server. For example, the wagering game server may be associated with a wagering game provider that provides wagering game content for placement on the third-party's website, or to be presented in connection with the website (e.g., as a webpage that includes branding of the online casino and which maintains a session connection with the player account associated the online casino). The wagering game provider can serve the third party entity (i.e., serve the online casino) a library of wagering games for presentation in connection with the online casino. The third-party server, on the other hand, manages the player account and the online casino.

The flow 300 continues at processing block 304, where the system reserves a portion of funds from the player account in an escrow account prior to initiation of a round of play for the wagering game content for which the portion of funds would be used for wagering. An example was described at processing block 202 and 203 of FIG. 2 where the wagering game server 250 communicates with the third-party server 270, prior to initiation of a round of play, and reserves funds in a reserve account. Additional examples will be described in FIGS. 4-8.

The flow 300 continues at processing block 306, where after the portion of funds are reserved in the escrow account, the system permits play of a wagering game. For example, the system provides access to wagering game content (e.g., the system provides access to a web page with the wagering game content). In another example, the system activates a control on wagering game content that permits wagering or that permits play of the wagering game (e.g., enables a wager control, a spin control, etc.).

The flow 300 continues at processing block 308, where, in response to a wager drawn from the portion of the funds in the escrow account, the system initiates the round of play of the wagering game. In some embodiments, a player utilizes the wagering game content to make a wager. For instance, the system can detect a user input by the player to set or select a wager amount. The player then provides an input that indicates a request to initiate play, for instance, by selecting a spin control for the wagering game player content. In some embodiments, the system detects whether the amount in the escrow account is sufficient to cover the wager. For example, the system detects whether the wager is less than or equal to the portion of the funds. In response to the input by the user to request initiation of the play, the system initiates the round of play. For the round of play, the system accesses the portion of the funds from the escrow account to fund the wager.

The flow 300 continues at processing block 310, where conducting the round of play, the system reserves an additional portion of the funds from the player account for use with a subsequent round of play that has not yet been initiated. For instance, as similarly described in FIG. 2, the wagering game server 250 conducted Stage A' and Stage B' in parallel. During Stage B', the wagering game server 250 communicated with the third-party server 270 to access additional funds from the player account and replenish the funds that were used from the reserve account for the ongoing round of play.

FIGS. 4 and 5 include a flow diagram ("flow 400") illustrating reserving and using funds in an escrow account, according to some embodiments. FIGS. 6, 7 and 8 are block diagrams that help illustrate the flow 400. Therefore, the description of FIGS. 4 and 5 will refer repeatedly to FIGS. 6, 7 and 8.

In FIG. 4, the flow 400 begins at processing block 402, where a wagering game system ("system") authenticates user credentials, received via user input at a client, to access a player account associated with a server. For example, in FIG. 6, a wagering game system ("system") 600 includes a client device (e.g., tablet computer 660) connected to a communications network 622 (e.g., the Internet). Also connected to the communications network 622 are an online casino server 670 and a wagering game server 650. The tablet computer 660 accesses a website 639 via a browser 601. The online casino server 670 hosts a wagering game player account ("player account") 671. The player account 671 is assigned to a player (e.g., the fictitious player "Marcus Miller" whose screen name is "M. Miller"). The online casino server 670 subscribes to a service of the wagering game server 650. The wagering game server 650 provides wagering game content to present via the website 639, such as a slot wagering game ("wagering game") 633. The website 639 may present a login screen (not shown) in which the player can enter user credentials, such as a username and password. The tablet computer 660 transmits the credentials, at stage "1," to the online casino server 670. The online casino server 670 logs in the user to the player account 671.

Returning momentarily to FIG. 4, the flow 400 continues at processing block 404, where the system requests a reservation, based on betting parameters, of an amount of funds ("reserve amount") from the player account for use as a wager to be subsequently made in a wagering game session. For example, in FIG. 6, the player account 671 includes a balance of a certain monetary value. At stage "1", the player account 617 has a balance of $503. Consequently, a credit meter 602 shows an equivalent amount of credits (e.g., 50300 credits, which is equivalent to $503 if one credit is equal to $0.01). At stage "2," the wagering game server 650 detects betting parameters that indicate a default wager value to reserve in the reserve account (i.e., in an escrow account 651) assigned to the wagering game session during the authentication process. In some embodiments, the default wager value depends on a denomination value for the wagering game 633. For instance, the wagering game 633 includes a denomination meter 605. A default amount for the denomination meter 605 may be set at a minimum value (e.g., $0.01) for the wagering game. In some embodiments, the default value for the denomination meter 605 may be set according to player preference or player history. For instance, the player may have a history of playing a specific denomination value, which the wagering game server 650 can select as a default reserve amount. In other embodiments, the denomination value for the wagering game 633 is not variable, therefore, the default value can be limited to only the one denomination value for the wagering game 633. In some embodiments, the wagering game 633 may also include a payline meter 603. The payline meter 603 can be variable. The payline meter 603 indicates a number of possible paylines that the player can win with for any given round of play. In some embodiments, the betting parameters may also indicate a default number of paylines. For example, in some embodiments, the payline meter 603 is set at a maximum value (e.g., 30 paylines). Thus, based on the denomination value (i.e., the $0.01) and the number of paylines (i.e., the 30 paylines) set by default during initialization of the gaming session (e.g., during authentication), a total bet amount meter 609 indicates a starting, total bet value of $0.30 (i.e., 30 paylines×$0.01=$0.30). Consequently, at stage "2," the wagering game server 650 requests, from the online casino server 670, to transfer $0.30 from the player account 671 to the escrow account 651.

Returning momentarily to FIG. 4, the flow 400 continues at processing block 406, where the system determines whether the player account balance is greater than the reserve amount. For example, in FIG. 6, at stage "2," when the wagering game server 650 requests, from the online casino server 670, to transfer $0.30 from the player account 671 to the escrow account 651, the online casino server 670 can detect whether the player account 671 has sufficient funds to transfer the requested reserve amount. For instance, the online casino server 670 determines that the player account has at least the $0.30. The online casino server 670 then transfers the $0.30 to the wagering game server 650, and deducts the reserve amount (e.g., deducts the $0.30 from the $503 initial amount in the player account 671 to be $502.60 as shown in FIG. 6).

Returning momentarily to FIG. 4, the flow 400 continues at processing block 408, where the system increments the escrow account with the reserve amount prior to placement of a wager (e.g., prior to providing access or use of functionality to make a wager). For example, in FIG. 6, at stage "2," after the online casino server 670 transfers the $0.30 amount to the wagering game server 650, the wagering game server 650 increments the escrow account 651 with the reserve amount (i.e., the $0.30). The escrow balance then increases to $0.30. In some embodiments, the website 639 also presents a control panel 604 (e.g., "QuickSpin" Settings). The control panel 604 shows an escrow-account balance meter 606, which shows an amount of the escrow balance. Prior to stage "2," the escrow account balance meter 606 would have showed a value of $0.00. However, when the wagering game server 650 increments escrow account 651 with the $0.30, then the escrow-account balance meter 606 increases to $0.30. In some embodiments, the credit meter 602 can remain at its previous value to indicate a total amount of funds that belong to the player account. Because the player account 671 still has possession rights to the amount in the escrow account 651, then the credit meter 602 may show a value that includes the amount in the escrow account 651.

Returning to FIG. 4, the flow 400 continues at processing block 410, where the system provides access to wagering functionality for wagering game content. For example, once the reserve amount has been added to the escrow account 651, the wagering game 633 is ready to begin play. Thus, the wagering game server 650 can indicate to the wagering game 633 to cause a spin control 613 to become usable for wagering, or in other words, to become selectable by player input. Prior to the escrow account 651 being funded (such as during an authorization process), the wagering game server 650 may prevent the spin control 613 from being selectable.

In other embodiments, the wagering game server 650 can delay presentation of the wagering game content (i.e., delay presentation of some or all of the wagering game 633, including the spin control 613) until the reserve account is funded.

Referring now to FIG. 5, after providing access to the wagering functionality, the flow 400 continues at processing block 412, where a loop begins for each round of play of a wagering game played in a wagering game session. More specifically, at processing block 414, the system detects a trigger of a round of play, such as an activation of a control associated with the wagering game content that indicates an instance of a round of play, for an amount of a wager ("wager amount"). For example, in FIG. 6, at stage "3," the wagering game server 650 detects that the spin control 613 is activated by user input. After the wagering game server 650 has provided access to wagering functionality, the player is free to select the spin control 613 for each round of play. Each selection of the spin control 613 can initiate a separate round of play. In some embodiments, the player may make changes to the bet lines in the payline meter 603 and/or to the denomination value in the denomination meter 605, thus changing the total bet amount shown in total bet meter 609. After detecting any changes to total bet value indicated in the total bet meter 609, the wagering game server 650 can dynamically update the reserve amount. For example, if the total bet value increases, the wagering game server 650 can repeat any, or all, of the operations associated with processing blocks 404, 406, 408, and 410. In some embodiments, to avoid having to update the reserve amount, the wagering game server could have, at processing block 404, selected a maximum total bet amount to reserve in the escrow account 651 (e.g., select a reserve amount that represents the highest denomination value times and the highest number of paylines available for the wagering game 633).

Returning to FIG. 5, the flow 400 continues at processing block 416, where the system determines whether the escrow balance is greater than or equal to the wager amount. If the system determines that the escrow balance is less than the wager amount, the flow 400 continues at processing block 418, wherein the system performs alternative transactioning. For example, the flow 400 can continue to processing block 424. In another example, the system can perform non-reserve-funded gaming transactions (e.g., as in FIG. 1). Referring again to processing block 416, if at processing block 416, the system determines that the escrow balance is sufficient to cover the wager amount (e.g., is greater than or equal to the wager amount), then the flow 400 continues on two parallel paths. The first path, comprising the processing blocks 436, 438, and 440, involves presenting the round of play for the wagering game (e.g., similar to processing blocks 206 and 208 of FIG. 2). The second path, comprising the processing blocks 420, 422, 424, 426, and 428, involves replenishing the escrow account for one or more subsequent wagers (e.g., similar to processing block 210 of FIG. 2).

Referring to the first path, the flow 400 continues at processing block 436, where the system deducts the wager amount from the escrow account and uses the wager amount for the wager of the round of play of the wagering game. For example, in FIG. 7, after the wagering game server 650 determines that the spin control 613 is selected by user input, and after the wagering game server 650 determines that the amount in the escrow account 651 covers the wager indicated in the total bet meter 609, at stage "4A," the wagering game server 650 deducts the amount for the wager from the escrow account 651 (e.g., uses the $0.30 amount in the escrow account to transact the wager). The balance for the escrow account becomes depleted (e.g., goes to the value $0.00), and the value indicated in the escrow-account balance meter 606 indicates the balance of the escrow account 651.

Returning momentarily to FIG. 5, the flow 400 continues at processing block 438, where the system determines a wagering game outcome for the round of play. For example, in FIG. 7, the wagering game server 650 generates a random number and determines an outcome for the wagering game 633 based on a value for the random number. For example, the wagering game server 650 selects an instance of a configuration array for the symbols of reels 607 that corresponds to the random number. The wagering game server 650 then determines whether the configuration for the array of symbols would result in any winning results based on the number of paylines indicated in the payline meter 603 (e.g., whether any paylines align with any winning reel-stop configurations of the symbols).

Returning momentarily to FIG. 5, the flow 400 continues at processing block 440, where the system provides game presentation parameters for presentation of the round of game play. For example, in FIG. 7, the wagering game server 650 indicates to the wagering game 633 to begin spinning the reels 607. The wagering game server 650 can further cause the spin control 613 to become temporarily inactive until the reels stop spinning The wagering game server 650 can further provide an indication of the wagering game outcome for presentation on the wagering game 633 (e.g., provides an indication of the symbol array configuration to present when the reels 607 stop spinning) The wagering game server 650 can further provide instructions regarding an amount of time to spin the reels 607 before revealing the wagering game outcome.

Returning momentarily to FIG. 5, now describing the second parallel path, the flow 400 continues at processing block 420, where the system determines whether betting parameters have changed since the last time that a reserve amount was stored in the escrow account. For example, in FIG. 7, the wagering game server 650 determines whether any of the betting controls (e.g., the payline meter 603, the denomination meter 605, and/or the total bet meter 609) have changed in value since the last time a wager was transacted using the escrow account 615. In some embodiments, the wagering game server 650 may further detect whether a bet factor value for a bet factor meter 608 has changed. The bet factor value is a multiple of the total bet value (indicated in the total bet meter 609). The bet factor meter 608 can be adjusted based on user preference. For example, the player may desire to store in the escrow account a reserve amount that is more than one unitary value (e.g., whole integer value) of the wager. As the bet factor value increases, the reserve value increases, causing larger amounts to be stored in the escrow account 651. Larger amounts in the credit account can speed up game processing. For example, the second parallel path of the flow 400 (e.g., the blocks 402, 422, 424, 426 and 428) may be deferred for one or more rounds of play, thus reducing any delays associated with replenishing the escrow account for those one or more rounds of play. In some embodiments, the bet factor meter 608 can be adjusted automatically based on player history. For example, if the player normally bets high amounts, bets very rapidly, etc. (or whose current betting trend involves higher bet amounts and/or faster betting) the wagering game server 650 can automatically set the bet factor to a value larger than "1×."

If, at processing block 420, the betting parameters have changed, then, at processing block 422, the system updates the reserve amount based on the changed betting parameters. For example, the system updates the reserve amount that should be deducted from the player account based on one or more of changes to paylines, denomination values, escrow bet factors, etc. since the last round of play. The flow 400 then continues at processing block 424. Further, if, at processing block 420, the betting parameters have not changed, then the flow 400 will continue to processing block 424 where the system requests a reserve amount from the player account based on the betting parameters. The reserve amount is for use as a subsequent wager to be made in the next round of game play. For example, in FIG. 8, at stage "4B", the wagering game server 650 requests, from the online casino server 670, an amount, from the player account 671, equivalent to the reserve amount (e.g., equivalent to $0.30).

Returning momentarily to FIG. 5, the flow 400 continues at processing block 426, where the system determines whether the player account balance is greater than the reserve amount. If the player account balance is not greater than the reserve amount, then the flow 400 can end because there are not sufficient funds to take from the player account to replenish the escrow account (e.g., there are insufficient funds to fund another round of play). However, if the player account balance is greater than the reserve amount, then, at processing block 428 the system adds the reserve amount to the escrow account prior to placement of a subsequent wager for another, future round of play. For example, in FIG. 8, the online casino server 670 deducts the reserve amount (i.e., the $0.30) from the player account 671 and sends a communication to the wagering game server 650 that the balance for the player account 671 would cover a subsequent bet. The wagering game server 650 then adds the reserve amount (i.e., the $0.30) to the escrow account 651. The escrow meter 606 also indicates an increase of the escrow account 651 with the reserve amount. The wagering game server 650 may, at this point, stop the spinning of the reels 607 and cause the wagering game outcome for the wagering game 633 to be revealed (e.g., send an indication to the tablet computer 660 to stop the reels 607 from spinning and present the outcome, along with any specific messages associated with wins or loses).

Returning momentarily to FIG. 5, the flow 400 continues at processing block 430, where the system determines whether a trigger occurs to terminate the session. For example, if a logout is requested, or if a game session terminates due to lack of user input within a given time period. If session terminates, the flow 400 continues at processing block 432, where the system returns the escrow balance to the player account. If, however, the session does not terminate, the system detects, at processing block 434, whether another round of play is triggered (e.g., the system detects whether the user selects the spin control again to make another wager). If another round of play is triggered, then the flow returns to processing block 412 to repeat the loop.

In some embodiments, the wagering game may enter a bonus round and fund wagers from a bonus account. As a result, processing block 434 the flow 400 can return to processing block 430, pause, break out of the loop, or perform some other action until another round of play is triggered where the player makes a wager of their own funds, at which point the flow 400 returns to processing block 412.

In some embodiments, timing for the flow 400 depends on which of the parallel paths completes last. In some embodiments, as mentioned previously, the system can wait to present the wagering game result (as part of presentation parameters mentioned in the processing block 440) until the reserve amount has been added to the escrow for a subsequent round of play (i.e., until the system completes processing block 428). In other embodiments, the system can present the wagering game outcome prior to completing the transaction to add the reserve amount to the escrow account. If the parallel path for replenishing the reserve account is not completed before the system performs processing block 416 (for a subsequent iteration of the loop) then the flow 400 can pause until the reserve account is replenished. The pause would still reduce delays compared to those for non-reserve-funded gaming because the process of replenishing the funds began during the previous round of play.

FIGS. 3-8 present examples of embodiments that utilize an escrow account, where funds in the escrow account are reserved periodically, such as during each round of play. Other embodiments include utilizing a credit account, wherein the reserve amount is capable of handling multiple rounds of play, such as for very rapid play of one game initiated by a player, for play of multiple overlapping rounds of play by the player, for concurrent rounds of play of multiple wagering games by the player, etc. FIG. 9 is a flow diagram 900 illustrating establishing and using credit for wagering game play, according to some embodiments. In FIG. 9, the flow 900 begins at processing block 902, where a wagering game system ("system") accesses a player account, as similarly described in FIG. 3.

The flow 900 continues at processing block 904, where, based on information of the player account, the system sets a credit limit of a credit account for wagering during a wagering game session. For example, similar to the escrow account described in FIGS. 3-8, a credit account is associated with, and readily accessible to, a wagering game server (e.g., the credit account is one or more of: stored on a memory device of the wagering game server; accessible via a device connected to the wagering game server; accessible on a device connected to a local area network to which the wagering game server is connected; etc.).

The flow 900 continues at processing block 906, where the system funds the credit account with an amount of funds equivalent to the credit limit, wherein the funds in the credit account are available to make one or more subsequent wagers on wagering game content presented during the wagering game session. For instance, the system can identify the player (e.g., via an identifier stored in the player account) and determine a credit limit for the player based on criteria related to one or more of: the player (e.g., the player's financial information, the player's personal information, etc.); the wagering game; the host of the player account (e.g., an online casino, a social network, etc.); a provider of the wagering game; etc.

The flow 900 continues at processing block 908, where, in response to a wager drawn from the amount of funds in the credit account, the system initiates a round of play for the wagering game content, wherein an amount of the wager is less than or equal to the amount of funds of the credit account. For example, the system can initiate the round of play in response to a selection of a game control (e.g., a spin control). The credit account is used to fund the wager. The system uses at least a portion of the funds of the credit account to transact the amount of the wager instead of accessing funds from the player account for the wager. For example, instead of waiting to transact a wager with a third-party server until after the round of play has initiated, the system has pre-funded the credit account and uses the funds from the credit account after the round of play is initiated.

FIGS. 10 and 11 include a flow diagram ("flow 1000") illustrating establishing and using credit for wagering game play, according to some embodiments. In FIG. 10, the flow 1000 begins at processing block 1002, where a wagering game system ("system") authenticates user credentials, received via user input at a client, to access a player account associated with a first server. The system can authenticate user credentials as similarly described in FIG. 4.

The flow 1000 continues at processing block 1004, where, based on credit risk criteria associated with the player account, the system sets a credit limit for the player account prior to placement of one or more wagers to be subsequently made on one or more wagering games provided by a second server, wherein the credit limit has a value sufficient for the one or more wagers. For example, the system can run a credit risk analysis on a player based on financial information of the player, such as an amount of funds in the player account. In some embodiments, the system can use additional information about the player in analyzing a credit risk, such as the player' income, payment history, history of borrowing, employment history, total outstanding consumer credit, household information, etc. Based on the analysis of the relevant information, the system can set a credit limit customized to the player. The amount of the credit limit can further be based on one or more of: a number of wagering games that the player intends to play during the wagering game session (e.g., if the player access two or more independent wagering games during the wagering game session); a denomination value for the wagering game; a history of past wager amounts; etc. In some embodiments, the credit limit is set based on betting parameters, such as a one or more of: a default betting amount; a maximum bet value for one or more wagering game accessed; etc.

The flow 1000 continues at processing block 1006, where the system funds the credit account to the credit limit. In some embodiments, the system increments a credit account balance to some value up to the credit limit.

The flow 1000 continues at processing block 1008, where the system provides the client access to wagering functionality of wagering game content after the credit account is funded. The system can provide access to wagering functionality as similarly described in FIG. 4.

Referring now to FIG. 11, the flow 1000 continues at processing block 1012, where a loop begins for each round of play of the one or more wagering games played in a wagering game session. For example, the system detects a trigger of a round of play (e.g., an activation or selection of a game control associated with the wagering game content that indicates initiation of a round of play), for an amount of a wager ("wager amount").

The flow 1000 continues at processing block 1016, where the system determines whether a credit balance is greater than, or equal to, the wager amount. If the credit balance is less than the wager amount, then the flow continues to processing block 1030 with alternative transactioning, such as utilizing an escrow account that holds only one wager amount at a time, or utilizing a non-reserve-funded gaming procedure (e.g., FIG. 1).

If, at processing block 1016, the system determines that the credit balance is greater than the wager amount, then the flow 1000 splits into two parallel paths. The first of the parallel paths includes processing blocks 1040, 1042, and 1044. The second of the parallel paths includes one or more of processing blocks 1017, 1018, 1020, 1022, 1024, 1026, 1028, and 1030. Each of the paths runs concurrently with the other, such that at least a portion of the processing blocks in the paths overlap in their performance.

The first parallel path will be described first, and then the second parallel path will be described. At processing block 1040, the system uses the credit account to transact the wager amount for the round of play for the wagering game. The system also decrements the credit account balance by the amount of the wager. The credit account balance can include funds for more than one wager, for more than one round of play of a wagering game, and/or for a plurality of rounds of play for concurrently played independent wagering games. As each of the rounds of play occur, as long as the credit balance is more than a wager amount for any of the rounds of play, then the system will deduct the wager amount for the individual rounds of play from the credit balance. The credit balance then decrements successively until it is replenished, or topped-off, to the credit limit (e.g., see processing block 1028).

The flow 1000 continues at processing block 1042, where the system determines a wagering game outcome for the round of play and, at processing block 1044, provides game presentation parameters for presentation of the round of game play. The system can perform the operations of processing blocks 1042 and 1044 similarly as for processing blocks 438 and 440 of FIG. 5.

As described previously, the system performs the second parallel path, beginning at processing block 1017, concurrently with the processing blocks described in the first parallel path. At processing block 1017, the system determines, based on reconciliation rules, whether the credit account needs to be reconciled. For example, the system determines whether the credit balance has dropped to a given threshold level (indicated in the rules) where a combined total of wager amounts for a given number of rounds of play should be communicated to a server (e.g., to a third-party server) that hosts the player account. In some embodiments, the operations at processing block 1017 enable the system to forgo performing the remainder of the second path for several rounds of play to reduce transactional delays that could occur by communicating with a second server across the Internet. For example, if the credit balance is large enough for a large set of rounds of play to be played, then, based on the reconciliation rules, the system would wait to reconcile (i.e., wait to communicate with the third-party server) until a threshold portion of the credit balance has been used (e.g., until half of the credit balance is used relative to the credit limit) or until a threshold portion of the set of rounds of play has been played (e.g., until half of the set of rounds of play had been played), before reconciling the credit account balance with the player account balance.

If the system determines, at processing block 1017, that a reconciliation is not needed, then the flow continues at processing block 1032. If, however, the system determines that a reconciliation is needed, then the flow continues at processing block 1018.

At processing block 1018, the system reconciles the credit account with the player account. For instance, the system communicates an amount of wagers that have been made from the credit account since the last time a reconciliation was made. For example, a wagering game server may communicate, to a third-party server that hosts the player account, the combined total of wager amounts that have been used from the credit account over a period of time or over a number of rounds of play. The third-party server subtracts the used credit amount from the player account balance. In some embodiments, the third-party server communicates back to the wagering game server an updated player account balance.

At processing block 1020 of the flow 1000, the system determines whether a credit risk assessment is triggered. For example, the system has access to credit risk rules that may indicate that if a credit account balance has dropped to half of its value relative to the credit limit, then the system initiates another credit risk analysis. For instance, if a player is extended a credit limit (at processing block 1004) sufficient to make one hundred spins in rapid succession, the system may (based on credit risk rules) determine, after fifty of those spins are made, that a re-assessment needs to be made of the credit limit. If so, then then the flow 1000 continues, at processing block 1022, where the system performs a credit risk assessment. The system requests an updated player account balance and uses the updated player account balance to perform the credit risk assessment. In some embodiments, the system performs the credit risk assessment using similar operations to those at processing block 1004. However, in this instance, instead of setting the credit limit, the system determines whether the credit limit is still within risk parameters, or whether the credit limit should be adjusted, based on the updated player account balance.

If, based on the credit risk assessment, the system determines that the credit risk is high (e.g., has exceeded credit risk criteria for the player, for example, because the player account balance is too low to extend any further credit), then at processing block 1026, the system sets the credit limit to zero. The flow 1000 can then continue, at processing block 1030, with alternative transactioning, such as utilizing an escrow account that holds only one wager amount at a time, or utilizing a non-reserve-funded gaming procedure (e.g., FIG. 1). It should be noted that the system can perform the credit risk assessment or request that the credit risk assessment be performed by a third-party. For example, instead of a wagering game server performing the credit risk assessment, the system can request that a third-party server (which hosts the player account) manage the credit limit and perform credit risk assessments.

If, at processing block 1022, the system determines that the credit risk is at a medium level (e.g., within a range that does not exceed credit risk criteria, but requires some downward adjustment to the credit limit), then the flow 1000 continues at processing block 1024 wherein the system adjusts the credit limit downward. For instance, the system may determine, based on the credit risk assessment, that the credit limit should be decremented to a value lower than the previous credit limit, but not to a value of zero. The system can assess degrees of credit risk based on different levels of the player account balance and/or based on different levels of other criteria (e.g., time between spins, increasing betting amounts during a wagering game session, etc.). For example, if the player account balance is above a minimum amount, but within a given range to the minimum amount, then the system can adjust the credit limit downward. In some embodiments, the system can adjust the credit limit downward in degrees, through successive rounds of play of the one or more wagering games, until the credit limit reaches zero.

If, at processing block 1022, the system determines that the credit risk criteria is low (e.g., because the player account balance is still above a certain level), then the system does not adjust the previous credit limit.

The flow 1000 continues to processing block 1028 where the system sets (e.g., increments) the credit account balance back to the credit limit (e.g., replenishes or tops-off the credit account with funds equivalent to the credit limit). If, at processing block 1024, the system lowered the credit limit to an amount equivalent to the credit account balance, then the system does not need to increment the credit account balance at his point. If the credit limit is lowered to a value lower than the previous credit limit, but higher than the current credit account balance, then the system increments the credit account balance up to the newly lowered credit limit. If, at processing block 1024, the system did not lower the credit limit, then the system increments the credit account balance to the credit limit. Furthermore, if, at processing block 1017, a reconciliation of the credit account is not triggered, then, at processing block 1028, the system increments the credit account balance to the credit limit (e.g., increments equivalent to the wager amount).

The flow 1000 continues at processing block 1032 where the system determines whether the session terminates. The system can determine whether the session terminates as similarly described for processing block 430 of FIG. 5.

If, at processing block 1032, the session terminates, then, at processing block 1036, the system can reconcile the player account based on transactions used during credit transactioning. For example, the system may communicate to a third-party server an amount of the credits used since last reconciling the player account, to update the player account balance. In another example, the system may permit more spending on wagers than the player account balance can cover (e.g., the risk assessment permits for credit borrowing beyond an amount of funds in the player account). In such a case, at processing block 1036, the system can indicate a total amount of credit spending and provide a report, for presentation to a player using player contact information (e.g., send a credit account statement to the player via an email address stored in the player account) showing the amount the player borrowed on credit for wagering, and payment information for paying back the borrowed amount.

Additional Example Embodiments

According to some embodiments, a wagering game system ("system") can provide various example devices, operations, etc., to conduct reserve-funded gaming. The following non-exhaustive list enumerates some possible embodiments.

Smoothing out timing for rounds of play using reserve-funded gaming. In some embodiments, the system can use reserve accounts to ensure that rounds of play have a consistent presentation timing. For example, non-reserve-funded gaming, such as that described in FIG. 1, can have an inconsistent time for the presentation of any given round. Network traffic, timing delays, unreliability in third-party devices or network, or other conditions, can vary between successive spins of a wagering game. As such, a non-reserve-funded wagering game would have to wait for the time required to communicate data between a wagering game server and a third-party server (e.g., the Stage A in FIG. 1 could be different for any given round of play for the wagering game because timing of communications between the wagering game server 150 and the third-party server 170 depends on the network conditions at the time of the round of play). However, when game presentation (e.g., Stage B' of FIG. 2) runs in parallel (i.e., overlaps some, or all of its operations) with the replenishing of a reserve account (e.g., Stage A' of FIG. 2), then the system can cause the presentation of the round of play to have a set amount of time even if the communication with the third-party server has not completed. For example, if the player does not select a spin control immediately after the round of play has completed, the system has time to complete the communication with the third-party server, especially because the communications were started during the presentation of the previous round of play. In some embodiments, the system can reserve more than one multiple of the wager amount so that if the communications have not completed before the set amount of time, and if the player initiates a subsequent round of play, then there is an additional reserve amount in the reserve account for use with the that subsequent round of play.

Augmenting a reserve account with winnings. In some embodiments, when a wagering game outcome results in a win, the system can reserve a portion of the win amount as the reserve amount. For example, instead of communicating all of the win amount to the player account (hosted by a third-party server), the system communicates the win amount minus the reserve amount. The system reserves the reserve amount (taken from the win) to replenish the reserve account before the next round of wagering game play. This can reduce further delays by reducing the need for a player-account balance check for a subsequent round of play.

Customizing a reserve amount to player information. In some embodiments, the system can customize the reserve amount to a player preference, such as by providing the bet factor meter 608 shown in FIGS. 6-8. Other examples include detecting a betting history of the player over a period of sessions. The system can review the betting patterns (e.g., amounts bet, times between spins, etc.) over those sessions and determine an average betting pattern, a trending betting pattern, or some other pattern in betting. Based on the betting pattern, the system can set the reserve amount.

Using multiple reserve accounts. In some embodiments, the system can fund multiple reserve accounts and draw on each of the reserve accounts in a sequential manner. For instance, the system may set up two reserve accounts. In some embodiments, a first of the reserve accounts is associated with a third-party player account. The system pre-funds the first reserve account from the third-party player account. The system can pre-fund a second of the reserve accounts with an additional account associated with the player, such as an additional third-party player account or with a financial account that belongs to the player (e.g., a bank account, a savings account, a credit card account, etc.). During a first round of play, the system draws a first wager from the first reserve account. During that round of play the system can initiate a transaction to replenish the first reserve account from the third-party player account. Then, for a second round of play (e.g., immediately after the first round of play), the system can draw a second wager from the second reserve account. During that second round of play the system can initiate a transaction to replenish the second reserve account from the additional account. On a third round of play, the system can return to using the first reserve account, which was replenished sometime after the first round of play was initiated (e.g., during the first round of play and/or during the second round of play). Thus, the system can utilize a queue of reserve accounts to provide a faster, and more reliable, source of reserve funds.

Example Operating Environments

This section describes additional example operating environments, systems, networks, etc. and presents structural aspects of some embodiments.

Wagering Game System Architecture

FIG. 12 is a conceptual diagram that illustrates an example of a wagering game system architecture 1200, according to some embodiments. The wagering game system architecture 1200 can include a player account server ("account server") 1270 configured to control user related accounts accessible via a communications network 1222. In some embodiments, the account server 1270 is akin to the third-party servers mentioned previously. The account server 1270 can store and track player information, such as identifying information (e.g., avatars, screen name, account identification numbers, etc.) or other information like financial account information, social contact information, etc. The account server 1270 can contain accounts for social contacts referenced by the player account. The account server 1270 can also provide auditing capabilities, according to regulatory rules, and track the performance of players, machines, and servers. The account server 1270 can include an account controller configured to control information for a player's account. The account server 1270 can also include an account store configured to store information for a player's account.

The wagering game system architecture 1200 can also include a wagering game server 1250 configured to control game content for a wagering game, provide random numbers, and communicate game information, account information, and other information to and from a client device 1260. The wagering game server 1250 can include a content controller 1251 configured to manage and control content for presentation via an application of the client device 1260. For example, the content controller 1251 can generate game results (e.g., win/loss values), including win amounts, for games played on the application of the client device 1260. The content controller 1251 can communicate the game results to the client device 1260. The content controller 1251 can also generate random numbers and provide them to the client device 1260 so that the client device 1260 can generate game results. The wagering game server 1250 can also include a content store 1252 configured to contain content to present on the client device 1260. The wagering game server 1250 can also include an account manager 1253 configured to control information related to player accounts. For example, the account manager 1253 can communicate wager amounts, game results amounts (e.g., win amounts), bonus game amounts, etc., to the account server 1270. The wagering game server 1250 can also include a communication unit 1254 configured to communicate information to the client device 1260 and to communicate with other systems, devices and networks. The wagering game server 1250 can also include a reserve-funded gaming module 1255 configured to manage reserve accounts for use with wagering games (e.g., online wagering games).

The wagering game system architecture 1200 can also include the client device 1260 configured to present applications for gaming, communication, scheduling, contacts, and so forth, and receive and transmit information to enable game play and present outcomes related to the game play. The client device 1260 can include a processor 1261 configured to manage and control content and presentation of content on the client device 1260. The client device 1260 can also include a memory 1262 configured to contain content to present on the client device 1260. The client device 1260 can also include a location unit 1263 configured to detect and communicate a geographic location of the client device 1260. The client device 1260 can also include an input/output controller 1264 configured to control input and output mechanisms and procedures. In some embodiments, the input/output controller 1264 is configured to use input devices to obtain information from a physical game card. In some embodiments, the input/output controller 1264 is configured to use output devices to present information about a secondary game. The client device 1260 can also include a communication unit 1265 configured to communicate data from the client device 1260 to various devices connected to the communications network 1222. In some embodiments, the communication unit 1265 is configured to communicate via a telecommunications network with a telecommunication server 1220.

Each component shown in the wagering game system architecture 1200 is shown as a separate and distinct element connected via the communications network 1222. However, some functions performed by one component could be performed by other components. For example, the wagering game server 1250 can also be configured to perform functions of the account server 1270 and other network elements and/or system devices. Furthermore, the components shown may all be contained in one device, but some, or all, may be included in, or performed by, multiple devices, as in the configurations shown in FIG. 12 or other configurations not shown. For example, the account manager 1253 and the communication unit 1254 can be included in the client device 1260 instead of, or in addition to, being a part of the wagering game server 1250. Further, in some embodiments, the client device 1260 can determine wagering game outcomes, generate random numbers, etc. instead of, or in addition to, the wagering game server 1250.

In some embodiments, wagering game machines (e.g., floor standing models, handheld mobile units, bar-top models, workstation-type console models, surface computing machines, etc.) and other devices configured to present wagering games, such as the client device 1260, work with wagering game servers such that wagering game machines and/or other devices can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, wagering game machines, mobile devices, etc., can be primarily dedicated for use in conducting wagering games.

In some embodiments, wagering game machines can include non-dedicated devices, such as mobile phones, personal digital assistants, personal computers, etc.

In some embodiments, a wagering game client or a wagering game server can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 1200 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Wagering Game Machine Architecture

FIG. 13 is a conceptual diagram that illustrates an example of a wagering game machine architecture 1300, according to some embodiments. In FIG. 13, the wagering game machine architecture 1300 includes a wagering game machine 1306, which includes a central processing unit (CPU) 1326 connected to main memory 1328. The CPU 1326 can include any suitable processor, such as an Intel® Pentium processor, Intel® Core 2 Duo processor, AMD Opteron™ processor, or UltraSPARC processor. The main memory 1328 includes a wagering game unit 1332. In some embodiments, the wagering game unit 1332 can present wagering games, such as video poker, video black jack, video slots, video lottery, reel slots, etc., in whole or part.

The CPU 1326 is also connected to an input/output ("I/O") bus 1322, which can include any suitable bus technologies, such as an AGTL+ frontside bus and a PCI backside bus. The I/O bus 1322 is connected to a payout mechanism 1308, primary display 1310, secondary display 1312, value input device 1314, player input device 1316, information reader 1318, and storage unit 1330. The player input device 1316 can include the value input device 1314 to the extent the player input device 1316 is used to place wagers. The I/O bus 1322 is also connected to an external system interface 1324, which is connected to external systems 1304 (e.g., wagering game networks). The external system interface 1324 can include logic for exchanging information over wired and wireless networks (e.g., 802.11g transceiver, Bluetooth transceiver, Ethernet transceiver, etc.)

The I/O bus 1322 is also connected to a location unit 1338. The location unit 1338 can create player information that indicates the wagering game machine's location/movements in a casino. In some embodiments, the location unit 1338 includes a global positioning system (GPS) receiver that can determine the wagering game machine's location using GPS satellites. In other embodiments, the location unit 1338 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 13, in some embodiments, the location unit 1338 is not connected to the I/O bus 1322.

In some embodiments, the wagering game machine 1306 can include additional peripheral devices and/or more than one of each component shown in FIG. 13. For example, in some embodiments, the wagering game machine 1306 can include multiple external system interfaces 1324 and/or multiple CPUs 1326. In some embodiments, any of the components can be integrated or subdivided.

In some embodiments, the wagering game machine 1306 includes a reserve-funded gaming module 1337. The reserve-funded gaming module 1337 can process communications, commands, or other information, where the processing can reserve funds for use in wagering games, such as to expedite wagering game play for wagering game content provided via online wagering game providers. For example, in some embodiments, the wagering game machine 1306 receives wagering game content from the external systems 1304 (e.g., via the game provider servers on the Internet).

In some embodiments, the wagering game machine 1306 provides content (e.g., one or more wagering game applications) for presentation in a wagering game session. The wagering game content can be stored on the wagering game machine 1306 (e.g., stored in main memory 1328) and/or a provided by a wagering game server (not shown) via a casino network. The wagering game machine 1306 can further provide an option to link into one or more "off-site" or "third-party" financial accounts (e.g., hosted by one or more third-party servers that are accessible using secure communications via the Internet). The one or more third-party servers provide funds for wagering on one or more wagering games during the wagering game session. The wagering game machine 1306 (e.g., the reserve-funded gaming module 1337) is configured to use one or more reserve accounts in which to reserve funds from the third-party financial accounts. In some embodiments, the wagering game machine 1306 is configured to use a player's local casino account (e.g., a player account accessible via a casino's local area network) as a reserve account for off-site, third-party accounts associated with the player. For example, the wagering game machine 1306 can aggregate, into the casino account, additional "non-local" accounts (e.g., for other loyalty accounts pertinent to other casinos, for third-party financial accounts, etc.). In some embodiments, a host (e.g., a casino) for the casino account charges a fee to the other accounts.

In another embodiment, the wagering game machine 1306 uses multiple reserve accounts (for multiple off-site accounts) and draws on each in a specific order or sequence. For instance, the wagering game machine 1306 can draw wagers from a reserve account associated with the local casino account until the funds from the local casino account are depleted. Then, the wagering game machine 1306 can draw on additional reserve accounts according to a preferred sequence. For instance, after the reserve account for the local casino account is depleted, then the wagering game machine 1306 draws on a reserve account linked to an off-site player account associated with a second casino. When that account is depleted, the wagering game machine 1306 draws on a reserve account linked to a checking account, then on a reserve account linked to a savings account, then on a reserve account linked to a credit card, and so forth. In some embodiments, the player can specify a preferred sequence from which the reserve accounts are used to drawn funds.

Furthermore, any component of the wagering game machine 1306 can include hardware, firmware, and/or machine-readable storage media including instructions for performing the operations described herein.

Wagering Game System

FIG. 14 is a conceptual diagram that illustrates an example of a wagering game system 1400, according to some embodiments. In FIG. 14, the wagering game system 1400 includes a wagering game machine 1460 similar to those used in gaming establishments, such as casinos. The wagering game machine 1460 may, in some examples, be referred to as a gaming terminal or an electronic gaming machine. The wagering game machine 1460 may have varying structures and methods of operation. For example, the wagering game machine 1460 may include electromechanical components configured to play mechanical slots. In another example, the 1460 includes electronic components configured to play a video casino game, such as slots, keno, poker, blackjack, roulette, craps, etc. The wagering game machine 1460 is depicted as a floor-standing model. However, other examples of wagering game machines include handheld mobile units, bartop models, workstation-type console models, etc. Further, the wagering game machine 1460 may be primarily dedicated for use in conducting wagering games, or may include non-dedicated devices, such as mobile phones, personal digital assistants, personal computers, etc. Exemplary types of wagering game machines are disclosed in U.S. Pat. No. 6,517,433 and Patent Application Publication Nos. US2010/0062196 and US2010/023 4099, which are incorporated herein by reference in their entireties.

The wagering game machine 1460 illustrated in FIG. 14 comprises a cabinet 1411 that may house various input devices, output devices, and input/output devices. By way of example, the wagering game machine 1460 includes a primary display area 1412, a secondary display area 1414, and one or more audio speakers 1416. The primary display area 1412 or the secondary display area 1414 may include one or more of a cathode ray tube (CRT), a high resolution liquid crystal display (LCD), a plasma display, a light emitting diode (LED) display, a three-dimensional (3D) display, a video display, or a combination thereof. In some examples, the primary display area 1412 or the secondary display area 1414 includes mechanical reels to display a wagering game outcome. In some example, the primary display area 1412 or the secondary display area 1414 present a transmissive video display disposed in front of a mechanical-reel display to portray a video image superimposed upon the mechanical-reel display. In FIG. 14, the wagering game machine 1460 is a "slant-top" version in which the primary display 1412 is slanted (e.g., at about a thirty-degree angle toward the player of the wagering game machine 1460). Another example of wagering game machine 1460 is an "upright" version in which the primary display 1414 is oriented vertically relative to the player. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the wagering game machine 1460. The wagering game machine 1460 includes a touch screen(s) 1418 mounted over the primary or secondary areas, buttons 1420 on a button panel, bill validator 1422, information reader/writer(s) 1424, and player-accessible port(s) 1426 (e.g., audio output jack for headphones, video headset jack, USB port, wireless transmitter/receiver, etc.). It should be understood that numerous other peripheral devices and other elements exist and are readily utilizable in any number of combinations to create various forms of a wagering game machine in accord with the present concepts.

Input devices, such as the touch screen 1418, buttons 1420, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system to perform a process according to embodiments(s), whether presently described or not, because every conceivable variation is not enumerated herein. A machine-readable storage medium includes any mechanism that stores information in a form (e.g., software, processing application) readable by a machine (e.g., a computer). For example, machine-readable storage media includes magnetic storage medium (e.g., floppy diskette), read only memory (ROM), random access memory (RAM), magnetic disk storage media, optical storage media (e.g., CD-ROM), magneto-optical storage media, flash memory, erasable programmable memory (e.g., EPROM and EEPROM), or other types of media suitable for storing electronic instructions. In addition, embodiments may be embodied in a machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method comprising:

electronically accessing via a network, by a first server, a second server associated with a remote account before initiation of a first round of play of a wagering game in an online environment, wherein the remote account is configured to, based on authorized player access, provide funding for one or more wagers on the wagering game based on funds available from the remote account, and wherein the first server is configured to control play of the wagering game in the online environment;

reserving, in a reserve account local to the first server and before initiation of the first round of play, a first portion of the funds from the remote account, wherein the first portion of the funds is reserved for one or more wagers on the wagering game wherein the reserving the first portion of the funds before the initiation of the first round of play prevents a delay arising from communications between the first server and the second server to, after the first round of play has been initiated, fund the first round of play using the remote player account;

in response to a first wager being drawn from the first portion of the funds in the reserve account, initiating, by at least one of one or more electronic processors of the first server, the first round of play; and in response to initiating and while conducting the first round of play, reserving in the reserve account, by at least one of the one or more electronic processors, a second portion of the funds accessible from the remote account, wherein the second portion of the funds is reserved for a subsequent second wager in a second round of the wagering game that has not yet been initiated.

2. The method of claim 1, wherein the first server and the second server are on different remote computer networks connected via the Internet, and wherein the reserve account is stored on a memory device accessible via one or more of a communications bus of the first server and a local area network to which the first server is connected.

3. The method of claim 1 further comprising:

before the reserving the first portion of the funds, detecting, based on wager configuration settings, a maximum bet amount for the first round of play of the wagering game, wherein the reserving the first portion of the funds comprises reserving an amount for the first portion of the funds equivalent to at least the maximum bet amount.

4. The method of claim 3 further comprising: using one or more of a player preference setting and a player betting history to determine a value of the first portion of the funds.

5. The method of claim 1 further comprising:

after reserving the second portion of the funds, detecting a trigger that indicates termination of play of the wagering game; and in response to the trigger, returning the second portion of the funds in the reserve account to the remote account without initiating the second round of play of the wagering game.

6. The method of claim 1, wherein the first wager for the first round of play is drawn from the reserve account, instead of from the remote account.

7. The method of claim 1, wherein the second server is associated with a wagering-game website provider, wherein the first server is configured to provide wagering game content for the wagering game to the wagering-game website provider, and wherein the first server is configured to manage the reserve account from which wagers are drawn to play the wagering game.

8. The method of claim 7, wherein the accessing the remote account comprises:

receiving credentials via a client that accesses the wagering-game website hosted by the wagering-game web site provider; and authenticating the credentials, wherein via the authenticating the credentials, the first server that provides the wagering game content obtains access to the remote account associated with the second server, wherein the remote accout is a wagering-game player account, and wherein the reserving the first portion of the funds is performed after the authenticating the credentials and before providing access to a control object, on the wagering-game website, configured to place the first wager for the first round of play.

9. A gaming system comprising:

one or more processors; and one or more memory storage devices configured to store instructions, which when executed by at least one of the one or more processors, cause the gaming system to perform operations for funding a wagering game, the instructions including instructions to access a remote account from a remote server before initiation of a first round of play of the wagering game in an online environment, wherein the remote account is configured for authorized player access to make one or more wagers on the wagering game using funds available from the remote account, and wherein the gaming system is configured to control play of the wagering game in the online environment, reserve a first portion of the funds in a reserve account associated with a memory store local to the gaming system before the initiation of the first round of play, wherein the first portion of the funds is reserved for one or more wagers on the wagering game, and wherein reservation of the first portion of the funds before the initiation of the first round of play prevents a delay arising from communications between the gaming system and the remote server to fund the first round of play after the first round of play has been initiated;

permit play of the wagering game after the first portion of the funds is reserved in the reserve account;

after the play of the wagering game is permitted, detect that a first wager is drawn from the first portion of the funds in the reserve account for the first round of play;

in response to the first wager being drawn from the first portion of the funds in the reserve account, initiate the first round of play; and in response to initiating and contemporaneous with the first round of play, reserve a second portion of the funds in the reserve account, wherein the second portion of the funds is reserved for a subsequent, second wager in a second round of the wagering game that has not yet been initiated.

10. The gaming system of claim 9, wherein the one or more memory storage devices are configured to store instructions, which when executed by at least one of the one or more processors, cause the gaming system to further perform operations to, before the first portion of the funds are reserved in the reserve account, detect, from wager configuration settings, a maximum bet amount for the wagering game, wherein the operation to reserve the first portion of the funds in the reserve account includes an operation to reserve an amount for the first portion of the funds equivalent to at least the maximum bet amount.

11. The gaming system of claim 10, wherein the one or more memory storage devices are configured to store instructions, which when executed by at least one of the one or more processors, cause the gaming system to further perform operations to, use one or more of a player preference setting or a player betting history to determine a value of the first portion of the funds.

12. The gaming system of claim 9, wherein the one or more memory storage devices are configured to store instructions, which when executed by at least one of the one or more processors, cause the gaming system to further perform operations to:

after the first round of play occurs, detect a trigger that indicates termination of play of the wagering game; and in response to the trigger, initiate a return of a balance of the reserve account to the remote account without initiating the second round of play.

13. The gaming system of claim 9, wherein the first wager for the first round of play is drawn from the reserve account, instead of the remote account.

14. The gaming system of claim 9, wherein the remote server is associated with a website host that hosts a website on which wagering game content for the wagering game is presented, wherein the gaming system is on a first computer network, wherein the remote server is on a second computer network different from the first computer network, and wherein the first computer network and the second computer network are connected via the Internet.

15. The gaming system of claim 14, wherein the one or more memory storage devices are configured to store instructions, which when executed by at least one of the one or more processors, cause the gaming system to further perform operations to:

receive credentials via a client that accesses the website; and authenticate the credentials, wherein via authentication of the credentials, the gaming system obtains access to the remote account via the remote server, wherein reservation of the first portion of the funds from the remote account in the reserve account is performed after the credentials are authenticated and before access is provided to a control object, on the website, configured to place the first wager for the first round of play.

16. The method of claim 1, wherein the reserving, in the reserve account, the first portion of the funds before the initiation of the first round of play comprises:

setting a credit limit of a local account, wherein the local credit account is local to the first server; and funding the local credit account with an amount of game credits equivalent to the first portion of the funds up to the credit limit before permitting the first round of play.

17. The gaming system of claim 9, wherein the one or more memory storage devices are configured to store instructions, which when executed by at least one of the one or more processors, cause the gaming system to perform operations to:

set a credit limit of a local credit account, wherein the local credit account is local to the gaming system; and fund the local credit account with the first portion of the funds equivalent to the credit limit before permitting the first round of play.

18. One or more non-transitory machine-readable storage media having instruction stored thereon, which when executed by a first server, cause the first server to perform operations for acquiring funds, the instructions comprising:

instructions to electronically access, via a wide-area network by a first server, a second server associated with a remote player account before initiation of a first round of play of a wagering game in an online environment, wherein the remote player account is configured to, based on authorized player access make one or more wagers on the wagering game using funds available from the remote player account, and wherein the first server is configured to control play of the wagering game in the online environment;

instructions to electronically transfer, to a reserve account local to the first server, a first portion of the funds from the remote player account before the initiation of the first round of play, wherein the first portion of the funds is reserved for one or more wagers on the wagering game, and wherein the electronic transfer of the first portion of the funds before the initiation of the first round of play prevents a delay arising from communications between the first server and the second server to, after the first round of play has been initiated, fund the first round of play using the remote player account;

instructions to in response to a first wager being drawn from the first portion of the funds in the reserve account, initiate, by at least one electronic processor of the first server, the first round of play; and instructions to, in response to initiating and while conducting the first round of play, transfer to the reserve account a second portion of the funds from the remote player account, wherein the second portion of the funds is reserved for a subsequent second wager for a second round of the wagering game that has not yet been initiated.

19. The one or more non-transitory machine-readable storage media of claim 18, wherein the first server and the second server are on different local area networks connected via the wide-area network, and wherein the reserve account is stored on a memory device accessible via one or more of a communications bus of the first server and one of the different local area networks to which the first server is connected.

20. The one or more non-transitory machine-readable storage media of claim 18, said instructions further comprising:

instructions to before the electronic transfer of the first portion of the funds, detect, from wager configuration settings, a maximum bet amount for the first round of play of the wagering game, wherein the instructions to electronically transfer the first portion of the funds comprise instructions to electronically transfer an amount for the first portion of the funds equivalent to at least the maximum bet amount.

21. The one or more non-transitory machine-readable storage media of claim 20, further comprising:

instructions to use one or more of a player preference setting and a player betting history to determine a value of the first portion of the funds.

* * * * *